US006808654B2

(12) United States Patent
Hayashi et al.

(10) Patent No.: US 6,808,654 B2
(45) Date of Patent: Oct. 26, 2004

(54) TRANSPARENT CONDUCTIVE FILM AND COMPOSITION FOR FORMING SAME

(75) Inventors: Toshiharu Hayashi, Saitama (JP); Tomoko Oka, Saitama (JP); Akira Nishihara, Saitama (JP)

(73) Assignee: Mitsubishi Materials Corporation, Tokyo (JP)

( * ) Notice: Subject to any disclaimer, the term of this patent is extended or adjusted under 35 U.S.C. 154(b) by 249 days.

(21) Appl. No.: 09/948,691

(22) Filed: Sep. 10, 2001

(65) Prior Publication Data

US 2002/0063242 A1 May 30, 2002

Related U.S. Application Data

(63) Continuation of application No. 09/546,666, filed on Apr. 10, 2000, now abandoned, which is a continuation of application No. 09/098,748, filed on Jun. 17, 1998, now Pat. No. 6,086,790.

(30) Foreign Application Priority Data

Sep. 5, 1997 (JP) ..... 9-241410
Sep. 5, 1997 (JP) ..... 9-242411

(51) Int. Cl.[7] ..... H01B 1/16; H01B 1/02; H01B 1/22

(52) U.S. Cl. ..... 252/512; 252/513; 252/514; 252/502; 252/519.31; 428/403; 428/405

(58) Field of Search ..... 252/500, 512, 252/513, 514, 519.31, 502; 428/403, 405, 407

(56) References Cited

U.S. PATENT DOCUMENTS 3,775,176 A 11/1973 Cross et al.
4,387,115 A 6/1983 Kitamura et al.
4,430,382 A 2/1984 Savit (List continued on next page.)

FOREIGN PATENT DOCUMENTS

| | | | |
|---|---|---|---|
| EP | 0 514 557 A1 | 11/1992 | |
| EP | 0 848 386 | 6/1998 | |
| JP | 2-255530 | 10/1990 | |
| JP | 5-107403 | 4/1993 | |
| JP | 5-290634 | 11/1993 | |
| JP | 5-337351 | 12/1993 | |
| JP | 6-12920 | 1/1994 | |
| JP | 6-234552 | 8/1994 | |
| JP | 6-344489 | 12/1994 | |
| JP | 7-268251 | 10/1995 | |
| JP | 07-268251 | * 10/1995 | ..... C09D/5/24 |
| JP | 10-204336 | 8/1998 | |

OTHER PUBLICATIONS

Japanese Office Action 1 and II/Reference No. M11X146P/ Notice of Reason for Refusal.

Patent Abstracts Of Japan/10–204336.

Patent Abstracts Of Japan/07–268251.

Patent Abstracts Of Japan/02–255530.

Patent Abstracts of Japan/05–337351.

*Primary Examiner*—Mark Kopec
*Assistant Examiner*—Kallambella Vijayakumar
(74) *Attorney, Agent, or Firm*—Oblon, Spivak, McClelland, Maier & Neustadt, P.C.

(57) ABSTRACT

The present invention discloses a double-layer structured low-resistance and low-reflectivity transparent conductive film, comprising a lower high-reflectivity conductive layer containing a fine metal powder in a silica-based matrix and a silica-based low-reflectivity layer, suitable for imparting electromagnetic shielding property and anti-dazzling property to a CRT.

17 Claims, 12 Drawing Sheets

U.S. PATENT DOCUMENTS 4,622,073 A 11/1986 Hashizume
4,826,631 A 5/1989 Sullivan
4,835,061 A 5/1989 Ohta et al.
4,950,423 A 8/1990 Sullivan
4,983,420 A 1/1991 Wolfrum et al.
5,455,117 A 10/1995 Nagano et al.
5,504,133 A 4/1996 Murouchi et al.
5,605,560 A 2/1997 Ono et al.
5,632,833 A 5/1997 Kurano et al.
5,879,417 A 3/1999 Yamada et al.
5,882,722 A 3/1999 Kydd
5,965,975 A * 10/1999 Chigusa et al. ..... 313/478
6,086,790 A 7/2000 Hayashi et al.
6,143,418 A * 11/2000 Takamiya et al. ..... 428/434

* cited by examiner

TRANSPARENT CONDUCTIVE FILM AND COMPOSITION FOR FORMING SAME

This application is a Continuation of application Ser. No. 09/546,666, filed on Apr. 10, 2000, now ABN, which is a continuation of Ser. No. 09/098,748 filed on Jun. 17, 1998, now U.S. Pat. No. 6,086,790.

BACKGROUND OF THE INVENTION

1. Field of the Invention

The present invention relates to a transparent conductive film low in reflectance and resistance, having a double-layer structure comprising a lower layer containing a fine metal powder and a silica-based upper layer and a composition for forming a transparent conductive film, suitable for forming the lower layer film described above. The transparent conductive film of the invention is suitable for imparting functions such as prevention of electrification, shielding of electromagnetic wave, and anti-dazzling property (prevention of disturbing reflection) to a transparent substrate such as a cathode ray tube (CRT) and an image display section of various display units.

2. Discussion of the Related Art

Glass composing an image display section (screen) of various display units such as a cathode ray tube (CRT for TV or display), a plasma display, an electroluminescence (EL) display, and a liquid crystal display is easily susceptible to deposition of dust on the surface under the electrostatic effect, and the insufficient anti-dazzling property leads to a problem of an unclear image as a result of external light or reflection of an external image. More recently, people are worrying about possible adverse effect of electromagnetic waves emitted from a cathode ray tube on human health and accordingly countries are enacting standards for low-frequency leaking electromagnetic waves.

As measures against deposition of dust or leakage of electromagnetic waves, it is possible to adopt means for forming a transparent conductive film or the outer surface of screen because of the electrification preventing effect or electromagnetic waves. It has been the conventional practice for imparting anti-dazzling property to apply a non-glare treatment of causing light scattering by providing fine irregularities to the screen glass surface with the use of hydrofluoric acid or the like. The non-glare treatment poses problems such as a lower resolution of the image and a decreased visibility.

Attempts have been made to impart functions of preventing electrification (preventing dust from depositing) and preventing reflection by means of a double-layer film having a transparent conductive film having a high refractive index and a transparent overcoat film having a low refractive index formed thereon. With such a double-layer film, particularly when there is a large difference in refractive index between the high-refractivity film and the low-refractivity film, the reflected light from the surface of the low-refractivity film, which is the upper layer, is offset by the interference of the reflected light from the interface with the high-refractivity film which is the lower layer, thus resulting in an improved anti-dazzling property.

When the transparent conductive film has a high electric conductivity, an electromagnetic wave shielding effect is also available.

For example, Japanese Unexamined Patent Publication No. 5-290,634 discloses a double-layer film having a reflectance reduced to 0.7% by a process comprising the steps of coating an alcoholic dispersed solution in which a fine Sb-doped tin oxide (ATO) powder is dispersed by the use of a surfactant onto a glass substrate, forming a conductive film having a high refractive index by drying the resultant film and forming thereon a silica-based low refractive film formed from alkoxysilane which may contain magnesium fluoride.

Japanese Unexamined Patent Publication No. 6-12,920 discloses findings that a low reflectance is available by causing a high-refractivity layer and a low-refractivity layer formed on a substrate to have an optical film thickness nd (n: film thickness, d: refractive index) of ½λ and ¼λ (λ=wavelength of incident light), respectively. According to this patent publication, the high-refractivity layer is a silica-based film containing a fine ATO or Sn-doped indium oxide (ITO) powder and the low-refractivity film is a silica film.

Japanese Unexamined Patent Publication No. 6-234,552 discloses also a double-layer film comprising an ITO-containing silicate high-refractivity conductive film and a silicate glass low-refractivity film.

Japanese Unexamined Patent Publication No. 5-107,403 discloses a double-layer film comprising a high- refractivity conductive film formed by coating a solution containing a fine conductive powder and Ti salt and a low-refractivity film.

Japanese Unexamined Patent Publication No. 6-344,489 discloses a blackish double-layer film comprising a first high-refractivity film consisting of a fine ATO powder, a black conductive fine powder (preferably, carbon black fine powder) in which solids are densely passed and a silica-based low-refractivity film formed thereon.

With a transparent conductive film using a semiconductor-type conductive powder such as ATO or ITO, however, it is usually difficult to achieve a lower resistance so as to give an electromagnetic wave shielding effect and even if it is possible to achieve a lower resistance, leads to a seriously decreased transparency. Particularly now that regulations on leaking electromagnetic waves from a CRT are becoming more strict than ever, it is difficult to cope with such circumstances with the foregoing conventional art because of an insufficient electromagnetic wave shielding effect and, as a result, there is an increasing demand for a transparent conductive film having a lower resistance and bringing about a more remarkable electromagnetic wave shielding effect.

Adoption of a vapor depositing process such as sputtering permits formation of a transparent conductive film having a high electromagnetic wave shielding effect but this technique cannot easily be adopted for a mass-produced product such as TV sets from cost consideration.

SUMMARY OF THE INVENTION

The present invention has, therefore, an object to provide a double-layer structured transparent conductive film having a low reflectivity, which has a low resistance so as to display an electromagnetic wave shielding effect on a high level, while maintaining a transparency and a low haze value so as not to impair visible identification of a CRT, and can impart an anti-dazzling function useful for preventing reflection of an external image.

Another object of the invention is to provide a transparent conductive film provided with a high contract property, in addition to the foregoing properties.

A further object of the invention is to provide a transparent conductive film in which the reflected light is not bluish or reddish but is substantially colorless.

A further object of the invention is to provide a transparent conductive layer forming composition excellent in film forming property, containing a fine metal powder, in which film irregularities such as color blurs, radial stripes and spots are alleviated or even eliminated.

A further object of the invention is to provide a transparent conductive film forming composition, excellent in storage stability, containing a fine metal powder.

The present inventors noted that, in view of the recent strict standards for electromagnetic wave shielding property of a CRT, it was desirable to use, not a fine inorganic powder of the semiconductor type such as ATO or ITO, but a fine metal powder having a higher conductivity as a conductive powder used for a transparent conductive film.

The present invention further provides a double-layer structured transparent conductive film having a low reflectance and electromagnetic wave shielding property, comprising a lower layer containing a fine metal powder in a silica-based matrix provided on the surface of a transparent substrate, and a silica-based upper layer provided thereon.

The lower layer containing the fine metal powder may contain a black powder (for example, titanium black) in addition to the fine metal powder. This improves contrast of the transparent conductive film.

In the lower layer, secondary particles of the fine metal powder may be distributed so as to form a two-dimensional net structure having pores not containing therein a fine metal powder. This enables a visible light to pass through the pores in the net structure, thus, considerably improving transparency of the transparent conductive film.

Further, the lower layer has concave and convex portions on the surface thereof. The lower layer convex portions have an average film thickness within a range of from 50 to 150 nm, and the concave portions have an average thickness within a range of from 50 to 85% of that of the convex portions. The convex portions may have an average pitch within a range of from 20 to 300 nm. This leads to a flat reflection spectrum from the transparent conductive film, resulting in substantially a colorless reflected light.

Accordingly, the present invention provides a composition forming a conductive film containing a fine metal powder suitable for use for the formation of the lower layer.

In an embodiment, the conductive film forming composition comprises a dispersed solution formed by dispersing a fine metal powder having a primary particle size of up to 20 nm in an amount within a range of from 0.20 to 0.50 wt. % in an organic solvent containing water. The solvent contains (1) a fluorine-containing surfactant in an amount within a range of from 0.0020 to 0.080 wt. %, and/or (2) a polyhydric alcohol, polyalkyleneglycol and monoalkylether derivative in a total amount within a range of from 0.10 to 3.0 wt. %. It is possible to form from this composition a conductive film excellent in film forming property in which film irregularities such as color blurs, radial stripes or spots are alleviated or even eliminated.

In another embodiment, the composition comprises an aqueous dispersed solution containing a fine metal powder having a primary particle size of up to 20 nm in an amount within a range of from 2.0 to 10.0 wt. %, with an electric conductivity of up to 7.0 mS/cm of the dispersant and a pH within a range of from 3.8 to 9.0. There is, thus, provided a conductive film forming composition containing a fine metal powder, excellent in storage stability, used by diluting with a solvent.

DESCRIPTION OF THE PREFERRED EMBODIMENTS

Figure 1:
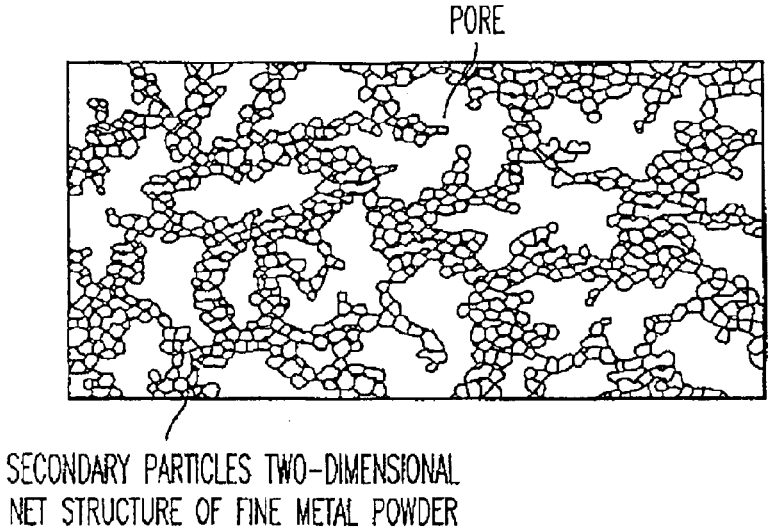
FIG. 1 is a descriptive view schematically illustrating the two-dimensional net structure of a fine metal powder of the lower layer in an embodiment of a double-layer structured transparent conductive film of the invention.

In the present invention, there is no particular limitation imposed on the transparent substrate on which a double-layer structured transparent conductive film is to be formed. Any arbitrary transparent substrate may be used, to which it is desirable to impart a low reflectance and an electromagnetic wave shielding property. While glass is a typical material for the transparent substrate, a transparent conductive film of the invention may be formed on a substrate such as a transparent plastic one.

As described above, transparent substrates particularly requiring to impart a low reflectance and an electromagnetic wave shielding property include image display section of a CRT, a plasma display, and EL display or a liquid crystal display used as a display unit for a TV set or a computer. A transparent substrate may be selected from these substrates.

The double-layer structured transparent conductive film of the invention has a low reflectance and an electromagnetic wave shielding property (a low resistance) and preferably, a high contrast, or has a flat reflection spectrum: it is colorless, not being tinted with blue-purple or red-yellow as in some of the conventional transparent conductive films, with a good visibility. When this conductive film is formed on the surface of an image display section such as a CRT, therefore, it is possible to prevent or reduce leakage of electromagnetic waves, deposition of dust, and disturbing reflection of an external image, which are detrimental to human health, and may cause a malfunction of computer. The film is satisfactory in transparency (visible light transmittance) and haze. A higher contrast and colorless reflected light permit maintenance of a good luminous efficacy of image, thus, providing a very visible screen. In a preferred embodiment, film forming property is improved, without film irregularities produced such as color blurs, radial stripes or spots, which may impair commercial value of the product, thus permitting easy formation of a transparent conductive film comprising fine metal particles.

The transparent conductive film of the invention is a double-layer comprising a lower layer (conductive layer) containing a fine metal powder as a conductive powder in a silica based matrix and a silica-based upper layer not containing powder. While the lower layer has a high refractive index because it densely contains the fine metal powder, the upper layer is low in refractive index. As a result of this double-layer film structure, the transparent conductive film of the invention has properties including a low reflectance and a low resistance and, thus, ban display the aforesaid functions.

In the transparent conductive film of the invention, both the silica-based matrix of the lower conductive layer and the silica-based upper layer can be formed from alkoxysilane (or more broadly a hydrolyzable silane compound) transformed into silica through hydrolysis.

As alkoxysilane, any one or more silane compounds having at least one, or preferably two or more, or more preferably three or more alkoxy groups can be used. As a hydrolyzable group, halosilanes containing halogen may be used with, or in place of, alkoxysilane.

More specifically, applicable alkoxysilanes include tetraethoxysilane (ethyl silicate), tetrapropoxysilane, methyltriethoxysilane, dimethyldimethoxysilane, phenyltriethoxysilane, chlorotrimethoxysilane, various silane coupling agents (for example, vinyltriethoxysilane, r-aminopropyltriethoxysilane, r-chloropropyltrimethoxysilane, r-mercaptopropyltrimethoxysilane, r-glycidoxypropyltrimethoxysilane, r-methacryloxypropyltrimethoxysilane, N-phenyl-r-aminopropyltrimethoxysilane, N-β-(aminoethyl)-r-aminopropyltrimethoxysilane, and β-(3,4-epoxycyclohexyl) ethyltrimethoxysilane). The preferred alkoxysilane is ethylsilicate which is the most easily hydrolyzed at the lowest cost.

In a film comprising alkoxysilane, alcohol is separated by hydrolysis and the produced OH groups condensate into silica sol. Baking by heating this sol causes further progress of condensation and eventually forms a hard silica ($SiO_2$) film. Alkoxysilane can, therefore, be utilized for forming a silica-based film as a silica precursor (component forming an inorganic film). When alkoxysilane is formed into a film together with a powder, it serves as an inorganic binder connecting powder particles and composes a matrix of the film. Although halo-silane can similarly form a silica film eventually through hydrolysis, use of alkoxysilane will be described below.

Lower Conductive Layer

The lower conductive layer of the transparent conductive film of the invention contains a fine metal powder in a silica-based matrix. The silica-based matrix can be formed from alkoxysilane as described above.

As the fine metal powder, powder of any arbitrary metal or alloy, or a powder mixture of metals and/or alloys may be used unless it exerts an adverse effect on film forming property of alkoxysilane. Preferred materials of the fine metal powder include one or more metals selected from the group consisting of Fe, Co, Ni, Cr, W, Al, In, Zn, Pb, Sb, Bi, Sn, Ce, Cd, Pd, Cu, Rh, Ru, Pt, Ag, and Au, and/or alloys thereof, and/or a mixture of these metals and/or alloys. More preferred metals from among those enumerated above are Ni, W, In, Zn, Sn, Pd, Cu, Pt, Rh, Ru, Ag, Bi, and Ad, or more particularly preferred are Ni, Cu, Pd, Rh, Ru, Pt, Ag, and Au. The most suitable material is Ag having a low resistance. Preferred alloys include Cu—Ag, Ni—Ag, Ag—Pd, Ag—Sn. and Ag—Pb, but alloys are not limited to these. A mixture of Ag with another metal (for example, W, Pb, Cu, In, Sn, and Bi) is also preferred as a fine metal powder.

One or more non-metal elements such as P, B, C, N and S, or alkali metals such as Na and K, and/or one or more alkali earth metals such as Mg and Ca may be dissolved in a solid-solution state in the fine metal powder.

The fine metal powder should have a particle size not impairing transparency of the conductive film. The average primary particle size of the fine metal powder is up to 100 nm (0.1 μm), or preferably up to 50 nm, or more preferably up to 30 nm, or most preferably, up to 20 nm. A fine metal powder having such an average particle size can be prepared by the application of a technique for producing colloid (for example, reducing a metal compound into a metal with an appropriate reducing agent in the presence of a protecting colloid).

In addition to the fine metal powder, an inorganic oxide based transparent conductive fine powder such as ITO or ATO (having an average primary particle size of up to 0.2 μm, or preferably, up to 0.1 μm) may simultaneously be used as a conductive powder. Even in this case, the fine metal powder should preferably account for at least 50 wt. %, or more preferably, at least 60 wt. % of the conductive powder.

In an embodiment of the invention, the lower conductive layer may contain a black powder, in addition to the fine metal powder, for the purpose of improving contact of image by imparting blackening property to the transparent conductive film. A conductive black powder is preferable as a black powder. In the invention, however, in which the highly conductive fine metal powder in coexistence imparts a sufficient conductivity, a non-conductive black powder may be used. The black powder preferably has an average primary particle size of up to 0.1 μm so as not to seriously impair transparency, although there is not particular restriction on the particle size.

Preferable conductive black powder materials include titanium black, graphite powder, magnetite powder ($Fe_3O_4$)

and carbon black. Among others, titanium black is the most preferable material because of a particularly high visible light absorbance. Titanium black is a powder of titanium oxide-nitride having a chemical composition represented by $TiO_x.N_y(0.7<x<2.0; y<0.2)$, without been bound to a theory, it is believed that above titanium black exhibits electric conductivity because of oxygen defects in crystal lattice. A particularly preferable titanium black is the one having a value of x in the foregoing composition within a range of from 0.8 to 1.2. AgO is a non-conductive black powder.

The blending ratio of the fine metal powder to the black powder in weight percentage should preferably be within a range of from 5:95 to 97:3, or more preferably, from 15:85 to 95:5. A part of the fine metal powder may be replaced by an inorganic oxide based transparent conductive powder such as ATO or ITO as described above.

With a smaller amount of fine metal powder, it is impossible to achieve a low resistance sufficient to ensure a satisfactory electromagnetic wave shielding property and, in addition, the larger amount of black powder leads to a lower transparency (visible light transmittance) of the film. With an amount smaller than that specified above of the black powder, there occurs a sharp increase in reflectance on the short wavelength side and on the long wavelength side in the spectroscopic reflectance curve of the visible region (reflection spectrum). Even when a target low reflectance as represented by a visible light minimum reflectance of up to 1.0% is achieved, the reflected light is tinted with blue-purple or red-yellow and visibility is seriously impaired.

Submicron fine particles of the fine metal powder present in the lower layer as a conductive powder are generally present in the form of secondary particles formed through aggregation of primary particles (individual particles).

According to another embodiment of the invention, as is schematically shown in FIG. 1, the film has a two-dimensional net structure formed through two-dimensional connection of secondary particles of the fine metal powder and pores are present in this net structure. Such a net structure can be formed by a method as described later.

The pores are almost exclusively packed by a silica-based matrix, containing almost no fine metal powder. The pore portions of the lower layer are, therefore, substantially transparent and most of visible light beams incident into the transparent conductive film at pore positions can pass through these pores, thus, resulting in an increased transmittance of visible light and in an improved transparency of the transparent conductive film.

On the other hand, visible light entering the film at portions of the net structure other than the pore portions (portions densely packed by connection of secondary particles of the fine metal powder) is reflected by the fine metal powder. However, these portions of the transparent conductive film have a high refractive index because of the presence of the fine metal powder in the lower layer and there is a considerable difference in refractive index from the silica-based upper layer having a low refractive index. As a result, the incident visible light at these portions of the transparent conductive film has a low reflectivity because of the difference in refractive index between the upper and the lower layers.

By distributing the secondary particles of fine metal powder in the lower layer so as to achieve a net structure having many pores therein, it is possible to achieve a higher transparency of the transparent conductive film by the presence of the pores while keeping a low reflectivity intrinsic to a double-layer film. In order to ensure achievement of this effect, the pores should preferably have an average area within the range of from 2,500 to 30,000 $nm^2$ and account for from 30 to 70% of the total area of the film.

In this embodiment, a coating material for forming a lower layer conductive film (film forming composition) is adjusted so that the secondary particles of fine metal powder are distributed to form a net structure upon coating of this coating material onto the substrate surface. The state of distribution of the secondary particles of fine metal powder in the coating material as coated is dependent upon such factors as the average primary particle size of fine metal powder, viscosity of the coating material and the surface tension of the solvent. It, therefore, suffices to select parameters such as the kind of solvent, the average primary particle size of fine metal powder, and the concentration of fine metal powder, so as to obtain a net structured distribution of the secondary particles of fine metal powder after coating. This selection can be made by any person skilled in the art through routing experimentation.

In this embodiment, the average primary particle size of the fine metal powder should preferably be within a range of from 2 to 30 nm. With an average primary particle size outside this range, it becomes difficult to form a net structure of the secondary particles of fine metal powder. A more preferable range of the average primary particle size is from 5 to 25 nm.

Figure 2:
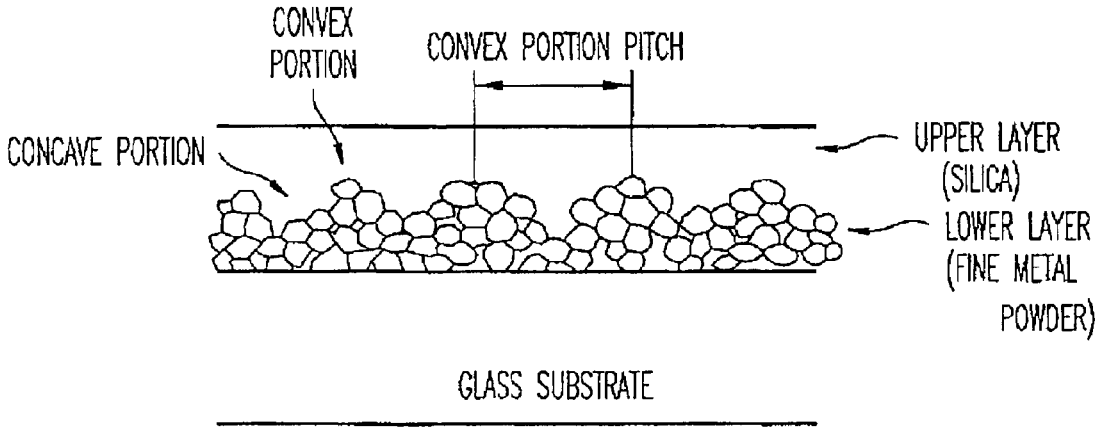
FIG. 2 is a descriptive view schematically illustrating a section of the double-layer structure in the embodiment of the transparent conductive film of the invention.

In another embodiment of the invention. the surface of the lower layer (i.e., interface between the upper and the lower layers) has a concave-convex shape as shown schematically in FIG. 2. In this embodiment, the lower layer has a thickness substantially equal to the average particle size of the secondary particles of fine metal powder to cause a relatively large dispersion in particle size distribution of the secondary particles (to achieve coexistence of large secondary particles and small secondary particles), thus, producing concave and convex portions on the surface of the lower layer. This inhibits increase in reflectance on both sides of a wavelength showing the lowest reflectance, bringing the reflected light nearer to colorless.

More specifically, in the lower layer surface having concave-convex portions, the convex portions should have an average thickness within a range of from 50 to 150 nm and the concave portions have an average thickness within a range of from 50 to 85% of that at the convex portions, with an average pitch of convex portions within a range of from 20 to 300 nm. The convex portion means a top of a crest in surface irregularities and the concave portion means a bottom of a root in surface irregularities. The lower layer having these convex and concave portions can be formed by a method described later.

When the convex portion has an average thickness smaller than 50 nm, effect of achieving a colorless reflected light brought about by the surface irregularities becomes less apparent. An average thickness at convex portions of over 150 nm leads to a decrease in transparency of the film and to a decrease in luminous efficacy of an image. An average thickness at the concave portions of under 50% of that at the convex portions results in an increase in haze because of an excessively step concave and convex portions and a decrease in luminous efficacy of image. When this value is over 85%, the irregularities are slow and there is available almost no effect of achieving colorless reflected light. With an average pitch of convex portions smaller than 20 nm, irregularities are small and the effect of achieving a colorless reflected light is slight. An average pitch of convex portions larger than 300 nm leads to an increase in haze of the film, a lower effect of bringing about a colorless reflected light and a decrease in luminous efficacy of images.

In this embodiment, the fine metal powder preferably has an average primary particle size within a range of from 5 to 50 nm. An average primary particle size smaller than 5 nm makes it difficult to form a lower conductive layer having relatively deep surface irregularities characterizing the present embodiment. With an average primary particle size larger than 50 nm, it is possible to form surface irregularities on the lower conductive layer but the pitch of crests and roots is too large. The average primary particle size should more preferably be within a range of from 8 to 35 nm.

The amount of the silica-based matrix in the lower conductive layer suffices to be sufficient to combine fine metal powder particles and other powder particles used as required. This conductive layer, being covered with a silica-based upper layer, does not require particularly high film strength or hardness. The amount of silica-based matrix should preferably be within a range of from 1 to 30 wt. %.

The lower layer should have a thickness within a range of from 8 to 1,000 nm, or preferably, from 20 to 500 nm. A lower layer thickness of under 8 nm does not permit imparting a sufficient conductivity or a low reflectivity. A thickness of over 1,000 nm impairs transparency of the film (visible light transmittance), and leads to a decrease in close adhesion resulting from produced cracks, thus, causing easy peeling of the film. The film thickness can be controlled by acting on the primary particle size and concentration of the fine metal powder in the coating material used, the film forming conditions (for example, revolutions of spin coat), and temperature of the substrate.

Upper Silica-Based Film

The layer is a film substantially comprising silica, having a low refractive index. The upper layer should preferably have a thickness within a range of from 10 to 150 nm, more preferably, from 30 to 120 nm, or further more preferably, from 50 to 100 nm. The film thickness can be controlled by acting on the concentration of a silica precursor (alkoxysilane or other hydrolyzable silane compound or hydrolysis product thereof) in the coating material used, the film forming conditions and temperature of the substrate.

General Forming Method of Transparent Conductive Film of the Invention

There is no particular restriction on the method of forming the double-layer structured transparent conductive film of the invention and, for example, the method described below can be adopted.

First, a coating material for forming a conductive film serving as the lower layer containing a fine metal powder and, as required, another powder (ATO, ITO or black powder) (film forming composition) is coated onto a transparent substrate to form a film containing the fine metal powder. The coating material can be prepared by dispersing the fine metal powder and the other arbitrary powder in an appropriate solvent. Dispersion can be accomplished by usual means used commonly for the manufacture of a coating material.

The coating material for forming the lower layer may or may not contain a binder comprising alkoxysilane (this may be at least partially hydrolyzed in advance) forming a silica-based matrix after baking. In any case, the amount of the fine metal powder in the coating material should appropriately be within a range of from 0.1 to 15 wt. % of the coating material, or particularly, from 0.3 to 10 wt. %. When alkoxysilane is contained, the amount of alkoxysilane (as converted into $SiO_2$) should preferably be within a range of from 1 to 18 wt. % relative to the total amount of alkoxysilane and the fine metal powder (and the other powder, if any).

When the coating material for forming the lower layer does not contain alkoxysilane serving as a binder, a film not containing a binder but comprising substantially the fine metal powder and, as required, the other arbitrary powder (an organic additive such as a surfactant may partially remain) is formed on the substrate surface by coating the coating material, drying the same to evaporate the solvent. Because the fine metal powder and the other powder comprise submicron fine powder and have a strong aggregation property, the film can be formed even in the absence of a binder. Evaporation of the solvent can be accomplished with or without heating, depending upon the boiling point of the solvent used. For example, when coating is carried out by the spin coat method, a sufficient duration of revolution ban cause evaporation during rotation without heating, varying, however, with the kind of the solvent. It is not necessary to completely evaporate the solvent but part of the solvent may remain.

Then the coating material for forming the upper layer, comprising a solution of alkoxysilane for forming the upper layer (alkoxysilane, may at least partially, be hydrolyzed in advance) is coated. Part of the coated solution penetrates into gaps between particles of the fine metal powder of the lower layer and the aforesaid pores of the net structure and a binder for combining the fine metal powder particles is supplied. As required, additives such as a surfactant for adjusting penetration may be added to the coating material. Coating of the coating material for forming the upper layer is carried out so that part of the coating material not having penetrated into the lower layer remains on the lower layer.

Then, the film is based by heating. Alkoxysilane is converted into a silica-based film and alkoxysilane having penetrated into gaps between the fine metal powder particles of the lower layer becomes a silica-based matrix filling up the gaps between particles and pores. Alkoxysilane in the solution not having penetrated and remaining on the lower layer forms an upper layer, thus completing the double-layer structured transparent conductive film of the invention.

In this method, the lower layer and the upper layer are baked at a time, thus accelerating hydrolysis of alkoxysilane during baking. It is desirable to use at least partially hydrolyzed alkoxysilane, and a particularly, substantially completely hydrolyzed alkoxysilane known as silica sol. Silica sol can be prepared by hydrolyzing alkoxysilane at room temperature or by heating in the presence of an acidic catalyst (preferably hydrochloric acid or nitric acid).

When using silica sol, the silica sol concentration in the coating material for forming the upper layer, as converted into $SiO_2$, should preferably be within a range of from 0.5 to 2.5 wt. %. This coating material preferably has a viscosity within a range of from 0.8 to 10 cps, or more preferably, from 1.0 to 4.0 cps. With a silica sol concentration lower than this range, connection of particles in the lower layer and the thickness of the upper layer become insufficient, and a concentration higher than this level leads to a lower film forming accuracy, thus, making it difficult to control the upper layer thickness. With a viscosity of the coating material higher than the above range, silica sol is prevented from penetrating sufficiently into gaps between powder particles of the lower layer, leading to a lower conductivity and a lower film forming accuracy, resulting in difficulty in controlling the thickness of the upper layer.

In this method, it suffices to carry out only one run of baking process requiring much time and a high energy cost, with a simplified manufacturing process. More specifically, while the coating process is carried out twice in this method, coating by the spin coat method permits continuous coating by sequentially dropping the coating material for the lower layer and the coating material for the upper layer on a single spin coater and then baking is carried out at a time. It is, therefore, possible to form a double-layer film through a simple operating process not so different substantially from a single run of coating. Because of the absence of a binder in the film of the fine metal powder formed first, the film is in a state in which the fine metal powder is in direct contact. This state is kept even after impregnation of alkoxysilane. An advantage lies in that an electron path structure is easily formed and the film has a further lower resistance.

When the coating material for forming the lower layer contains alkoxysilane as a binder, a conductive layer containing a fine metal powder in a silica-based matrix of a lower layer by the coating material containing the fine metal powder and the binder onto a transparent substrate and then converting alkoxysilane into the silica-based matrix through baking of the coated film. Then, a coating material for forming the upper layer comprising an alkoxysilane is coated and the coated film is baked again. It is therefore necessary to carry out two steps of baking.

A thickness-direction cross-section of double-layer structured transparent conductive film of the invention formed by the first method (in which the lower layer forming coating material does not contain a binder) was investigated. The result reveals that the content of the powder in the lower conductive layer does not sharply increase from the interface with the upper layer but increases slowly. On the other hand, when the film is formed by the second method (in which the lower layer forming coating material contains a binder), the powder content of the conductive powder in the lower layer suddenly increases from the interface with the upper layer.

The double-layer structure formed by the first method gives a smaller variation of the visible light minimum reflectance upon a change in thickness of the lower conductive layer. More specifically, reflectance becomes minimum when the value of (thickness (nm))×(refractive index) is equal to $\lambda/4$ ($\lambda$ is the incident light beam wavelength <nm>). In the double-layer film formed by the first method, the visible light minimum reflectance can be kept on a low level even when the thickness of the lower layer largely deviates from this value. The second method is, on the other hand, advantageous in that thickness of each layer can be easily controlled, i.e., it is possible to easily control the thickness of the upper and the lower layers so as to achieve the lowest visible light minimum reflectance.

There is no particular restriction on the solvent used for preparing the coating material so far as the solvent can disperse the fine metal powder. Applicable solvents include, but are not limited to, for example, water, alcohols such as methanol, ethanol, isopropanol, butanol, hexanol, and cyclohexanol; ketones such as acetone, methylethylketone, methylisobutylketone, cyclohexanone, isoholone, and 4-hydroxy-4-methyl-2-pentanone; hydrocarbons such as toluene, xylene, hexane and cyclohexane; amides such as N,N-dimethylformamide, and N,N-dimethylacetoamide; and sulfoxides such as dimethylsulfoxide. One or more solvents can be used.

For a coating material containing alkoxysilane, i.e., the lower layer forming coating material containing a binder and the upper layer forming coating material, it is desirable to select a solvent which is not converted into gel quickly and can dissolve the binder. Preferable solvents include a solvent comprising one or more alcohols and a mixed solvent of an alcohol, other solvent and/or water. As alcohol, apart from alkanol such as ethanol, alkoxyalcohol such as 2-methoxyethanol may be used alone or in combination with alkanol.

Alkoxysilane applicable as a binder in the coating materials for forming the lower layer and the upper layer can partially be hydrolyzed in advance. This permits completion of baking after coating in a short period of time. Hydrolysis in this case should preferably be carried out in the presence of an acidic catalyst (for example, an inorganic acid such as hydrochloric acid, or an organic acid such as p-toluenesulfonic acid) and water to promote the reaction. Hydrolysis of alkoxysilane can be conducted at the room temperature or by heating and the preferable range of reaction temperature is from 20 to 80° C.

When using the upper layer forming coating material, it suffices to use the alkoxysilane solution as it is or use the same after at least partial hydrolysis.

Coating of the coating material can be accomplished by the spray method, the spin coat method or the dipping method. The spin coat method is the most desirable in terms of the film forming accuracy. The viscosity of the coating material is adjusted so that a desired film thickness is achieved, depending upon the coating method adopted. In general, the viscosity of the coating material used in the present invention should preferably be within a range of from 0.5 to 10 cps or more preferably from 0.8 to 5 cps.

Baking after coating should preferably be carried out at a temperature of at least 140° C. in general. When the transparent substrate is a CRT, baking should be conducted at a temperature of up to 250° C., or preferably, up to 200° C., or more preferably, up to 180° C. to ensure a high size accuracy of the substrate and to prevent peeling of a fluorescent body. For a transparent substrate other than a CRT, a higher baking temperature may be adopted within a range allowable for the substrate material.

Transparent Conductive Film of Which the Lower Layer Contains Black Powder

The coating material used for forming the lower conductive layer containing a black powder is formed by dispersing a fine metal powder and a black powder in an appropriate solvent. The solvent may contain alkoxysilane as a binder. The total amount of the fine metal powder and the black powder in the coating material should preferably be within a range of from 0.5 to 20 wt. %, or more preferably, from 1.0 to 15 wt. %.

In a preferred embodiment, the coating material further contains at least one titanium compound selected from the group consisting of alkoxytitanium (this may be a hydrolyzed product thereof) and a titanate coupling agent. The titanium compound serves as a film reinforcing agent and effective for achieving uniform connection of particles of the fine metal powder and the black powder in the lower conductive layer and for ensuring a stable low resistance excellent in reproducibility.

When using this titanium compound, the amount thereof relative to the total amount of the fine metal powder and the black powder should be within a range of from 0.1 to 5 wt. %, or preferably, from 0.2 to 2 wt. %. With an amount of lower than 0.1 wt. %, the above-mentioned effect is unavailable and an amount of higher than 5 wt. % impairs electronic paths between the powder particles and results to a lower conductivity.

Applicable examples of alkoxytitanium used in the invention include tetraalkoxytitanium such as tetraisopropoxytitanium, tetrakis (2-ethylhexoxine) titanium, and tetrastearoxytitanium; and tri-, di- or monoalkoxytitanium titanium such as diisopropoxy-bis (acetylacetonate) titanium, di-n-butoxy-bis (triethanolaminate) titanium, dihydroxy-bis (lactate) titanium, and titanium-i-propoxyoctilene glycolate. Among others, tetraalkoxytitanium is preferable. Alkoxytitanium may be used as a partial hydrolysis product. Hydrolysis of alkoxytitanium can be accomplished in the same manner as in hydrolysis of alkoxysilane.

On the other hand, examples of applicable titanate-based coupling agent include isopropyltriisostearoyltitanate, isopropyltridecylbenzenesulfonyltitanate, isopropyltris (dioctylpyrophosphate) titanate, tetraisopropyl (dioctylphosphite) titanate, tetraoctylbis (ditridecylphosphite) titanate, tetra (2,2-diaryloxymethyl-1-butyl) bis (di-tridecyl) phosphate titanate, bis (dioctylpyrophophate) oxyacetate titanate, and tris (dioctylpyrophosphate) ethylene titanate.

When the lower layer forming coating material does not contain a binder, it is desirable to add at least one alkoxyethanol or P-diketone to the solvent. Alkoxyethanol and P-diketone have a function of reinforcing connection between fine conductive powder particles and improves film forming property of a coating material not containing a lower layer forming binder. This improves film forming accuracy, resulting in a smoother surface, thus, giving a lower conductive layer having reduced haze and reflectance.

Examples of alkoxyethanol include 2-methoxyethanol, 2-(methoxyethoxy) ethanol, 2-ethoxyethanol, 2-(n-, iso-) propoxyethanol, 2-(n-, iso-, tert-) butoxyethanol, 1-methoxy-2-propanol, 1-ethoxy-2-propanol, 1-(n-, iso-) propoxy-2-propanol, 2-methoxy-2-propanol, and 2-ethoxy-2-propanol. Examples of β-diketone include 2,4-pentanedion (acetylacetone), 3-methyl-2,4-pentanedion, 3-isopropyl-2,4-pentanedion, and 2,2-dimethyl-3,5-hexanedion. As β-diketone, acetylacetone is preferable.

The coating material may further contain other additives. Examples of the other additives particularly include surfactants useful for improving dispersibility of the black powder (cationic, anionic and nonionic). When the coating material contains alkoxysilane as a binder, an acid may be added to accelerate hydrolysis of alkoxysilane. When the coating material does not contain a binder, on the other hand, a pH adjusting agent (an organic acid or an inorganic acid such as formic acid, acetic acid, propionic acid, butyric acid, octilic acid, hydrochloric acid, nitric acid and perchloric acid, or amine), or a slight amount of an organic resin can be added. In order to keep a satisfactory dispersion stability of the fine metal powder and the black powder dispersed in the coating material not containing a binder, pH of the solution should preferably be within a range of from 4.0 to 10, or more preferably, from 5.0 to 8.5.

Thickness of the lower layer containing the fine metal powder and the black powder should preferably be within a range of from 20 to 1,000 nm, or more preferably, from 30 to 600 nm.

The double layered transparent conductive film, of which the lower layer contains the black powder, has optical features including a low resistance, a blackish transparency, and a low reflectivity. Conductivity of the transparent blackish conductive film largely varies with the kind and the amount (ratio to black powder) of the fine metal powder in the lower layer and the surface resistance of the film varies generally within a range of from the level of $10^0\Omega/\square$ to about $10^5\Omega/\square$.

In the transparent blackish conductive film of the invention, which contains the black powder in the lower conductive layer, a blue-purple or a red-yellow tint in a conventional double- layered film is eliminated and the film of the invention is substantially colorless. In spite of the dense content of the fine metal powder and the black powder in the lower layer, the conductive film maintains a partially sufficient transparency as typically represented by a haze of under 1% and a whole light transmittance of at least 60%. Because the film has a silica layer of a low refractive index as the upper layer, the film can exhibit such a low visible light minimum reflectance of under 1%. The blackish color permits improvement of contrast of images.

Transparent Conductive Film of Which the Lower Layer has Two-Dimensional Net Structure When the fine metal powder particles in the lower layer are distributed so as to form a two-dimensional net structure having pores not containing the fine metal powder therein, there is available a large improvement of transparency of the conductive film. For the purpose of forming such a lower layer, irrespective of the presence of alkoxysilane serving as a binder, the kind of solvent in the coating, the average primary particle size of the fine metal powder, and the concentration of the fine metal powder are adjusted so that, after coating, secondary particles of the fine metal powder are distributed to form a two-dimensional net structure.

For example, a coating material not containing alkoxysilane serving as a binder can be prepared from a dispersed solution in which the fine metal powder particles are distributed in a solvent containing a dispersant. The dispersant can be selected from polymer dispersants and surfactants. Examples of polymer dispersant include polyvinyl pyrrolidone, polyvinyl alcohol, and polyethyleneglycol-mono-p-nonylphenylether. The surfactant may be a nonionic, a cationic, or an anionic surfactant. Examples include p-sodium aminobenzenesulfonate, sodium dodecylbenzensulfonate, and a long-chain alkyltrimethylammonium salt (e.g., stearyltrimethylammonium chloride).

In this embodiment, when the fine metal powder has an average primary particle size within a range of from 2 to 30 nm and the solvent contains at least one of from 1 to 30 wt. % propyleneglycolmethylether, from 1 to 30 wt. % isopropylglycol and from 1 to 10 wt. % 4-hydroxy-4-methyl-2-pentanone, it is easy for the secondary particles of fine metal powder to form a net structure upon coating the coating material.

The net of the solvent should preferably comprise water and/or a low-grade alcohol such as methanol, ethanol, isopropanol or butanol. The solvent is not, however, limited to those enumerated above but a coating material may be prepared by using any arbitrary solvent so far as the solvent permits formation of the foregoing net structure when coating the coating material.

Even when the lower layer forming coating material contains alkoxysilane as a binder, use of the three aforesaid solvents propyleneglycolmethylether, isopropylglycol, and 4-hydroxy-4-methyl-2-pentanone is effective for forming the net structure. It may be however necessary to change the amount thereof. In all cases, the solvent to be used may be selected by routine experimentation.

The lower layer forming coating material may contain a titanate-based or aluminum-based coupling agent. A titanate-based coupling agent may be selected from those enumerated above. Applicable aluminum-based coupling agents include acetoalkoxy aluminiumdiisopropylate.

The amount of added dispersant or coupling agent is small as within a range of from 0.001 to 0.200 wt. % relative to the dispersant solution (coating material).

The thickness of the lower conductive layer formed with this coating material should preferably be within a range of from 10 to 200 nm, or more preferably, from 25 to 150 nm. A thickness of the lower layer of over 200 nm makes it difficult to form the net structure of the secondary particles of the fine metal powder.

The double-layered transparent conductive film of which the lower layer forms a two-dimensional net structure having pores not containing the fine metal powder therein has optical features including a reflected light which is not bluish but almost colorless, a high transparency, and a low reflectivity. More specifically, the visible light transmittance is as high as at least 60%, or preferably, at least 70%, or more preferably, at least 75%, and the haze is as low as up to 1%. In addition to a low minimum reflectance of 1%, the reflection spectrum is flat and the increase in reflectance on the short wavelength side (e.g., 400 nm) having so far caused the bluish reflected light of the conventional double-layered conductive film is inhibited to a level not so different from that on the long wavelength width (e.g., 800 nm). As a result, the reflected light is not bluish but substantially colorless, thus, improving luminous efficacy of images.

In this transparent conductive film, the secondary particles of the fine metal powder serving as conductive powder are connected together to form a net structure and electric current flows through this connection structure of the fine metal powder. In spite of a relatively low degree of packing of the fine metal powder (pores are present), therefore, surface resistance is low as within a range of from 102 to 108 Q/E, thus, permitting sufficient display of the electromagnetic wave shielding function.

Transparent Conductive Film of Which the Lower Layer has Surface Concave/Convex Portions The reflected light from the transparent conductive layer becomes almost colorless when the lower layer surface has concave and convex portions, with an average thickness at the convex portions within a range of from 50 to 150 nm, an average thickness at the concave portions within a range of from 50 to 85% of that at convex portions and an average pitch of the convex portions within a range of from 20 to 300 nm. The convex portion means a top of a crest in the surface irregularities and the concave portion means a bottom of a root in the surface irregularities.

A coating material used for forming a lower layer having such surface concave and convex portions is preferably prepared from a dispersed solution in which fine metal powder particles, having an average primary particle size within a range of from 5 to 50 nm, are dispersed in a solvent containing a dispersant. It is desirable that this coating material does not contain alkoxysilane becoming a silica-based matrix after baking.

Irrespective of the presence of alkoxysilane serving as a binder, the lower layer forming coating material is adjusted so that the secondary particle of fine metal powder has a specified particle size distribution in the coating material. More specifically, the fine metal powder particles having an average primary particle size within a range of from 5 to 500 nm should aggregate in the coating material to form secondary particles having a particle size distribution having a 10% cumulative particle size of up to 60 nm, a 50% cumulative particle size within a range of from 50 to 150 nm, and a 90% cumulative particle size within a range of from 80 to 500 nm.

The state of aggregation of the fine metal powder in the dispersed solution (i.e., the particle size distribution of the secondary particle) is dependent upon the average primary particle size of the fine metal powder, the surface tension of solvent, the stirring conditions upon dispersion of powder particles, viscosity of the dispersed solution, and additives such as a dispersant. It, therefore, suffices to select parameters such as the kind of solvent, an average primary particle size of the fine metal powder, a concentration of the fine metal powder, stirring speed and time, and a kind and an amount of additives so that the particle size distribution of the secondary particles of fine metal powder is within the foregoing range. A person skilled in the art could therefore reach an appropriate result in this regard through routine experimentation.

A solvent suitable for such dispersion of the fine metal powder is a mixed solvent in which water and/or a low-grade alcohol (methanol, ethanol, isopropanol or the like) are mixed with a cellosolve-based solvent (e.g., methylcellosolve, butylcellosolve or the like) in an amount of up to 30 wt. %, or more preferably, up to 25 wt. %. The solvent is not however limited to this but a dispersed solution may be prepared by the use of any arbitrary solvent so far as such a solvent can disperse the fine metal powder particles in a condition of aggregation so as to form secondary particles having a particle size distribution within an aforesaid range.

The dispersant used for the lower layer forming coating material may be the same as that described above. The coating material may contain a titanate-based or an aluminum-based coupling agent. Contents of these additives may be the same as above.

The coating material preferably is coated so as to achieve an average thickness at the convex portions of the surface irregularities of the film after drying within a range of from 50 to 150 nm. Since this thickness range is the same as that of the 50% cumulative particle size of the secondary particles of fine metal powder, the coated film substantially comprises a single layer of secondary particles, so that the particle size distribution of the secondary particles is directly expressed on the coated film surface as surface irregularities. If the secondary particles of fine metal powder have a particle size distribution as described above, therefore, there is available a coated film of fine metal powder having the foregoing surface concave and convex portions after drying and removal of the solvent.

Even when the lower layer forming coating material contains alkoxysilane, the secondary particles of fine metal powder precipitate within the coated film, since the fine metal powder has a far higher density as compared with that of the alkoxysilane solution. In this case, concave and convex portions are produced in response to dispersion of particle size of the secondary particles at portions containing the fine metal powder. Although the formed film has a smooth surface, part of the alkoxysilane solution accumulated on the concave portions of the irregularities forms a silica-based film not containing the fine metal powder after baking and finally combined with the silica-based film of the upper layer, thus forming a part of the upper layer film. That is, of the coated film formed of the lower layer coating material, only the portions containing the fine metal powder become the lower layer and the lower layer has surface concave and convex portions because these portions have concave and convex portions.

Because the interface between the lower layer of a high refractive index containing the fine metal powder and the upper layer comprising only silica having a low refractive index has appropriate irregularities, the double-layered transparent conductive film of the invention has optical features including a low reflectance, a reflected light which is not bluish or reddish but almost colorless, a high transparency, and a low haze. More specifically, the visible light transmittance is at least 55%, or preferably, so high as at least 60% and the haze is low as up to 1%. The visible light reflectance is typically represented by a low minimum reflectance of 1%, with a flat reflection spectrum and the increase in reflectance on the short wavelength side (for example, 400 nm) so far having caused a bluish reflected light in the conventional two-layered conductive film is inhibited to substantially the same level as that on the long wavelength side (for example, 800 nm). As a result, the reflected light is not bluish but almost colorless, thus remarkably improving the luminous efficacy of images. The transparent conductive film has a low surface resistance of about 102 Q/E, thus, permitting full display of the electromagnetic wave shielding function.

Transparent Conductive Film with Inhibited Film Blurs

A lower conductive layer of which film blurs are inhibited can be formed from a coating material comprising a dispersed solution in which fine metal powder particles having a primary particle size of up to 20 nm in an amount within a range of from 0.20 to 0.50 wt. % are dispersed in a dispersion medium comprising an organic solvent containing water, in which the dispersant contains one or both of the following (1) and (2).

(1) fluorine-containing surfactant within a range of from 0.0020 to 0.080 wt. %; and (2) at least one selected from the group consisting of 1) polyhydric alcohol and 2) polyalkyleneglycol and monoalkylether derivatives, in a total amount within a range of from 0.10 to 3.0 wt. %.

The fine metal powder used in this embodiment should preferably contain Fe in a slight amount as an impurity. Fe is an impurity element mixing into the fine metal powder upon generation of a metal colloid other than Fe. It is already known that Fe in a slight amount mixed into the fine metal powder as an impurity exhibit a uniform distribution of conductivity on the surface of the formed conductive film and a low resistance. In order to obtain this effect, the Fe element should preferably be present as an impurity in an amount within a range of from 0.0020 to 0.015 wt. % relative to the total amount of the coating material. An Fe content of over 0.015 wt. % may cause an adverse effect on film forming property.

A fine metal powder having a primary particle size of up to 20 nm is employed. The conductive film comprising the fine metal powder should preferably have a small thickness of up to 50 nm to ensure a satisfactory visible light transmittance. Therefore, the primary particle size of the fine metal powder must be sufficiently smaller than the film thickness. Presence of a large amount particles having a primary particle size of over 20 nm tend to easily cause film blurs, as described above, and leads to a decrease in film forming property.

The term "primary particle size" means the primary particle size obtained by excluding primary particle sizes of the uppermost 5% and the lowermost 5% in the primary particle size distribution. It suffices, therefore, that, among the remaining fine particles after exclusion of uppermost 5%, the largest fine particle has a primary particle size of up to 20 nm.

The primary particle size of fine particles in a dispersed solution can be measured, for example, from a photograph of fine metal powder taken by TEM (transmission type electron microscope). In this method, the primary particle size of 100 fine metal particles selected at random is measured. The primary particle size of the fine particles remaining after exclusion of the five largest fine particles and the five smallest fine particles is adopted as the measured value of primary particle size. It suffices that the largest from among the measured vales of primary particle size is up to 20 nm.

The upper limit of primary particle size of fine metal powder should preferably be 15 nm. When the fine metal powder does not contain particles having a primary particle size of over 15 nm, transparency of the film tends to be improved. In this embodiment, there is no is particular restriction on the particle size distribution. The primary particle size of the fine metal powder can be controlled by acting on the reaction conditions upon generation of metal colloid.

Extra-fine metal particles having a primary particle size of up to 20 nm can be manufactured by the use of a conventionally known metal colloid generating technique (for example, reducing a metal compound into a metal by means of an appropriate reducing agent in the presence of a protecting colloid). Salt by-produced in the reducing reaction is removed by a salt removing method such as the centrifugal separation/repulping method or the dialysis method. The generated fine metal particles are obtained in a state of a metal colloid, i.e., an aqueous dispersed solution (the dispersant medium comprises water alone or mainly water).

The aqueous dispersed solution of fine metal particles is diluted with an organic solvent or an organic solvent and water to achieve a content of the fine metal particles within a range of from 0.20 to 0.50 wt. %. The content of the fine metal particles is kept at such a low level because the film formed therefrom has a very small thickness of up to 50 nm. With a content of fine metal particles of over 0.50 wt. %, it becomes difficult to form such a thin film and the visible light transmittance of the resultant film becomes lower. In addition, film forming property becomes poorer, making it difficult to prevent occurrence of film blurs. With a content of fine metal particles of under 20 wt. %, the formed film is very thin and conductivity of the film is seriously reduced. The content of fine metal particles should preferably be within a range of from 0.25 to 0.40 wt. %.

There is no particular restriction on the water content in the solvent after dilution but it should preferably be up to 20 wt. %, or preferably, up to 10 wt. %, relative to the weight of the composition. A large content of water leads to much time for drying of the film, resulting in operability.

Since the dispersant of the fine metal particles before dilution, the organic solvent used for diluting should preferably contain at least partially a water-miscible organic solvent. To accelerate drying upon forming the film, it should preferably comprise mostly (for example, more than 60% of the solvent) a solvent having a boiling point of up to 85° C.

Particularly preferable water-miscible organic solvents include mono-valent alcohols such as methanol, ethanol and isopropanol. Other water-miscible organic solvents including ketones such as acetone are also applicable. A water-miscible organic solvent such as a hydrocarbon, ether or ester may also be used, preferably together with a water-miscible organic solvent. The most desirable organic solvents for dilution include methanol, ethanol and mixed solvents thereof. Among others, it is desirable to use methanol alone or a mixed solvent of methanol and ethanol.

As described above, however, when aqueous colloid containing the fine metal particles having a primary particle size of up to 20 nm is only diluted with a volatile solvent as described, the fine metal particles tend to easily aggregate and the distribution thereof tends to easily become non-uniform. Use thereof as a composition for forming a conductive film, therefore, leads to an insufficient film forming property. As a result, even when this composition is sufficiently stirred and immediately used for coating the substrate, film blurs tend to occur on the resultant transparent conductive film.

Occurrence of film blurs can be effectively prevented by adding to the lower layer forming coating material, any one or both of (1) a fluorine-based surfactant and (2) one or more selected from a polyhydric alcohol, polyalkyleneglycol and monoalkylether derivative thereof. While the mechanism of this effect is not as yet known in detail, it is conjectured that addition of these additives stabilizes the state of dispersion of the fine metal powder and prevents easy occurrence of aggregation, thus leading to improvement of film forming property.

The fluorine-based surfactant is a surfactant containing a perfluoroalkyl group. The perfluoroalkyl group should preferably have a carbon number within a range of from 6 to 9, or more preferably, from 7 to 8. While there is no particular restriction on the kind of surfactant, anionic surfactant is preferred.

More specifically, preferred surfactants are ones expressed by the following general formulae:

$$(C_nF_{2n+1}SO_2N(C_3H_7)CH_2CH_2O)_2PO_2Y$$

where, n=7 or 8, Y=H or $NH_4$);

$$C_nF_{2n+1}S_3X$$

(where, n=7 or 8, X=H, Na, K, Li or $NH_4$)

$$C_nF_{2n+1}SO_2N(C_2H_7)CH_2CO_2X'$$

(where, N=7 or 8, Xl=Na or K); or $$C_nF_{2n+1}CO_2Z$$

(where, n=7 or 8, Z=H, Na or $NH_4$).

The amount of added fluorine-based surfactant (when using two or more the total amount) should be within a range of from 0.0020 to 0.080 wt. % relative to the lower layer forming coating material. When this amount is under 0.0020 wt. %, the film blur preventing effect becomes insufficient and when it is over 0.080 wt. %, the interface activating action becomes too strong and film blurs tend to occur again. Occurrence of film blurs may sometimes cause a decrease in electric conductivity. The amount of added fluorine-based surfactant should preferably be within a range of from 0.0025 to 0.060 wt. %, or more preferably from 0.0025 to 0.040 wt. %.

Polyhydric alcohol, polyalkyleneglycol and a monoalkylether derivative thereof (hereinafter these are collectively referred to as "glycol-based solvent" for simplicity) are used as a solvent. That is, one in liquid state is used. However, a solvent of this type, having a high boiling point (even ethyleneglycol-monomethylether having the lowest boiling point has a boiling point of 124.5° C.) is not applicable as a main solvent.

Concrete examples of glycol-based solvents applicable in the invention are as follows. Examples of polyhydric alcohol include ethylene glycol, propylene glycol, triethylene glycol, butylene glycol, 1,4-butanediol, 2,3-butanediol, and glycerine. Examples of polyalkyleneglycol and monoalkylether derivative thereof include diethylene glycol, dipropylene glycol and monomethylether and monoethylether thereof.

The amount of added glycol-based solvent (when two or more are used, the total amount) is within a range of from 0.10 to 3.0 wt. %. An amount of addition of under or over this range leads to a lower film forming property and exhibits insufficient prevention of occurrence of film blurs and may result in a decrease in conductivity. The amount of added glycol-based solvent should preferably be within a range of from 0.15 to 2.5 wt. %, or more preferably, from 0.50 to 2.0 wt. %.

Addition of any one of the foregoing fluorine-based surfactant and glycol-based solvent is sufficiently effective for the prevention of occurrence of film blurs but addition of both more certainly ensure the effect.

A binder should preferably be absent in the lower layer forming coating material. Other additives to the coating material, which do not exert adverse effects on film forming property or film properties, may be added to the composition. Example of such additives include surfactants, other than fluorine-based ones, coupling agents and masking agents utilizing chelate formability. All these additives serve as protecting agents stabilizing dispersion of the fine metal powder. Since addition of these additives in an excessive amount has an adverse effect on film formability, the amount of addition should preferably be up to 0.010 wt. % in any case.

Surfactants other than the fluorine-based, may be anionic, nonionic or cationic type. One or more selected from silane coupling agents, titanate-based coupling agents or aluminum-based coupling agents may be used as the coupling agent. Applicable masking agents include citric acid, ethylenediaminetetracitic acid (EDTA), acetic acid, oxalic acid, and salts thereof.

The lower layer, formed from the lower layer forming coating material, substantially comprising the fine metal powder preferably has a thickness of up to 50 nm. The fine metal powder film preferably has a thickness within a range of from 8 to 50 nm, more preferably, from 10 to 30 nm. A thickness smaller than this level does not permit achievement of a sufficient electric conductivity.

When an upper layer forming coating material is coated, as described above, over the lower layer film, a part of the coating material penetrates into gaps of the lower layer film comprising the fine metal powder, thus giving a double-layered transparent conductive film of the invention. Thus, the formed upper layer preferably has a thickness within a range of from 10 to 150 nm, or more preferably, from 30 to 110 nm.

This double-layered film has a low reflectivity, and is further provided with conductivity and transparency under the effect of the fine metal powder film. Regarding conductivity, the thin silica-based upper layer exerts only slight impairment on conductivity. In contrast, contraction caused by baking of the upper layer applies an internal stress on the fine metal powder in the lower layer, ensuring smoother communication, and exhibits an improved conductivity as compared with the fine metal powder alone. This result in a transparent conductive film having a surface resistance of up to $1\times10^3\Omega/\square$ and a desirable low resistance for electromagnetic wave shielding. There is even an improvement of transparency because of the reflection of the fine metal powder film.

As a result, this double-layered film can display the electromagnetic wage shielding function and anti-dazzling function (preventing ingression of external image or a light source) and is suitable for application to a CRT or an image display section of various display units. However, because the reflection spectrum is not flat but reflectance is higher toward the short wavelength side of the visible region, the hue of image changes slightly into blue or blue-purple, thus, impairing the image quality to some extent.

It is now known that formation of silica-based fine irregularity layer by spraying a silica precursor solution onto this double-layered film makes the reflection spectrum flat, eliminates changes in tint of images, and improves anti-dazzling property through scattering of the surface reflected light. The fine irregularities should preferably have a height (difference in height between convex and concave portions) within a range of from about 50 to 200 Å.

Because an object of this spray is to form fine irregularities on the surface, the slightest amount of spray suffices (for example, about ¼ in weight of an overcoat). The silica precursor may be the same as that used for the overcoat of the upper silica-based film and ethyl silicate or a partial hydrolyzed product thereof is the most desirable. The concentration of the silica precursor in the solution as converted into $SiO_2$ should preferably be within a range of from 0.5 to 1.0 wt. %, or more preferably, from 0.6 to 0.8 wt. %. To accelerate film formation, the substrate may be preheated prior to spraying.

Lower Layer Conductive Film Forming Coating Material Excellent in Storage Stability In an embodiment of the invention, there is provided a high-concentration conductive film forming composition (i.e., original solution for dilution) comprising an aqueous dispersed solution containing fine metal powder having a primary particle size of up to 20 nm, to be used by diluting with a solvent. The transparent conductive film comprising the fine metal powder is a very thin film having a thickness of up to 50 nm for ensuring transparency. It is necessary to achieve a very low concentration of the fine metal powder in the coating solution.

When selling the product with a concentration suitable for coating, therefore, the required volume of solution would be very large and this is not efficient. It is therefore desirable to sell the coating material in the form of a high-concentration original solution to have the users use the same after dilution with an appropriate solvent. In this case, because the original solution is stored, the original solution is required to exhibit satisfactory storage stability. This embodiment therefore covers the original solution, i.e., the conductive film forming composition to be used by dilution.

The extra-fine-metal particles having primary particle size of up to 20 nm are manufactured by using the metal colloid generating technique as described above, and the by-product salts are removed by a salt removing method such as the centrifugal separation/repulping method or the dialysis method as described above. Fine metal particles are, thus, available in the form of an aqueous dispersed solution (metal colloid). Thereafter, as required, the concentration is adjusted by adding pure water and/or an organic solvent to achieve a content of fine metal powder in the solution within a range of from 2.0 to 10.0 wt. %. When using an organic solvent for concentration adjustment, the kind and amount of the organic solvent should be at a range as described below.

According to the invention, a dispersed solution of fine metal powder having an electric conductivity of the dispersing medium of up to 7.0 mS/cm and a pH within a range of from 3.8 to 9.0 us obtained by carrying out allout desalting during formation of metal colloid. When the dispersing medium satisfies these conditions, the dispersed solution exhibits excellent storage stability. For example, when the dispersed solution is stored at the room temperature for about a month and then used after dilution to a concentration equal to that of the coating solution, a coating solution excellent in film formability free from film blurs is obtained and the formed fine metal powder film is provided with sufficient performance also in terms of conductivity and transparency.

When electric conductivity of the dispersing medium is higher than 7.0 mS/cm or pH is outside the aforesaid range, there is an increase in the amount of salt which causes aggregation of the fine metal particle dispersed solution, thus leading to a lower storage stability: for example, upon coating the diluted solution after storage at the room temperature for a month, the coating solution is poor in film formability, and film blurs occur on the formed transparent conductive film. The electric conductivity of the dispersing medium is preferably up to 5.0 mS/cm, and the pH, within a range of from 5.0 to 7.5.

For the purpose of achieving satisfactory film formability, fine metal particles having a primary particle size of up to 20 nm are used and as in the just preceding embodiment, should preferably contain Fe in a slight amount as an impurity.

As described above, the conductive film forming composition of the invention used as an original solution for dilution contains a fine metal powder in an amount within a range of from 2.0 to 10.0 wt. %. With the amount of fine metal powder of under 2.0 wt. %, the volume of the solution becomes too large, a disadvantage in storing as an original solution. A concentration of fine metal powder of over 10.0 wt. % causes a decrease in storage stability of the dispersed solution.

An organic solvent can be used for adjusting the content of fine metal powder within a range of from 2.0 to 1.0 wt. %. In this case, the amount of the organic solvent in the dispersed solution after adjustment of concentration (content relative to the total amount of composition) should not exceed the following upper limit. An amount of each organic solvent exceeding the limit exerts an adverse effect on storage stability, leading to a decrease in film formability.

(1) For methanol and/or ethanol, up to 40 wt. % in total;

(2) For 1) polyhydric alcohol and 2) polyalkyleneglycol and monoalkylether derivative thereof, up to 30 wt. %;

(3) For ethyleneglycolmonomethylether, thioglycol, α-thioglycerol and dimethylsulfoxide, up to 15 wt. % in total; and (4) For organic solvents other than the above, up to 2 wt. % in total.

Preferable amounts for the organic solvents (1) to (4) above are (1) up to 30 wt. %, (2) up to 20 wt. %, (3) up to 10 wt. %, and (4) up to 1.0 wt. %, respectively.

Preferable examples of polyhydric alcohol applicable in the invention include ethyleneglycol, propyleneglycol, triethyleneglycol, butylene-glycol, 1,4-butanediol, 2,3-butanediol and glycerine. Preferable examples of polyalkyleneglycol and monoalkylether derivatives thereof include diethyleneglycol, dipropyleneglycol, and monomethylether and monoethylether thereof.

For any of (1) to (4) above, one or more can be used and any combination of (1) to (4) is applicable. That is, only one organic solvent selected from (1) to (4) above may be used, or two to four organic solvents may be used in combination. There is no particular restriction on the other solvents given in (4) and any of nitrogen-containing compounds such as ketone, ether, and amine, polar solvents including ester, and non-polar solvents such as hydrocarbons may be used. When the total amount is up to 2 wt. %, there is no seriously adverse effect on storage stability of the conductive film forming composition of the invention.

For the stabilization of the fine metal powder, at least one selected from surfactants, coupling agents, and making agents may be added as a dispersion protecting agent to the conductive film forming composition of the invention used as an organic solution for dilution. The content of the protecting agents in this case should be up to 1.0 wt. % in total. A content of the protecting agent layer than this leads to an adverse effect on conductivity of the transparent conductive film, thus making it difficult to obtain a film having a low resistance sufficient to impart electromagnetic wave shielding property. The content of the protecting agent should preferably be up to 0.5 wt. %.

An anionic or a nonionic type surfactant is preferable. Examples of anionic type surfactants include, but are not limited to, sodium alkylbenzenesulfonate (e.g., sodium dodecylbenzenesulfonate), alkylsodium sulfonate (e.g., dodecylsodium sulfonate) and fatty acid sodium (e.g., sodium oleate). Examples of nonionic surfactants include, but are not limited to, alkylester or alkylphenylether of polyalkylglycol, sorbitan or fatty acid ester of sucrose, and monoglycceride.

Another applicable surfactant is a fluorine-based surfactant. A fluorine-based surfactant may be selected from ones enumerated above.

The coupling agent and the masking agent may be handled in the same manner as above.

This conductive film forming composition is an original solution having a high content of fine metal powder and is used by diluting upon coating for forming a transparent conductive film. Water (pure water) and/or an organic solvent may be used for dilution. The organic solvent may be a mixed solvent of two or more solvents. Since the dispersing medium of the fine metal powder before dilution contains water, at least a part of the organic solvent should preferably be a water-miscible organic solvent. To accelerate drying upon film forming, post part of the solvent after dilution (for example, at least 60%, or preferably, at least 70%, or more preferably, at least 80%) should preferably comprise a solvent having a boiling point of up to 85° C.

In view of these considerations, the solvent for dilution should be monohydric alcohol and, particularly, methanol and ethanol. Particularly, use of methanol alone or a mixed solvent of methanol and ethanol for dilution can accelerate drying and. for example, evaporate the solvent during spin coating, thus, eliminating the necessity to provide a separate drying time and, hence, permitting more efficient film forming operation.

Dilution should preferably be carried out so that the content of fine metal powder in the coating solution obtained after dilution is within a range of from 0.20 to 0.50 wt. %. Since the content of fine metal powder before dilution is within a range of from 2.0 to 10.0 wt. %, dilution would be to about 10 to 20 times on the average. Such reduction of the content of fine metal powder is because the film to be formed should have a very small thickness of up to 50 nm.

A content of fine metal powder of over 0.50 wt. % makes it difficult to form an extra-thin film of up to 50 nm, leads to a lower visible light transmittance of the resultant film and, further, to a poorer film formability, thus, making it difficult to prevent occurrence of film blurs. With a content of fine metal powder of under 0.20 wt. %, the formed film would be too thin, resulting in a serious decrease in conductivity of the film. The content of fine metal powder should preferably be within a range of from 0.25 to 0.40 wt. %.

Film formability of the diluted coating solution is improved when the coating solution contains any or both of component (1) a fluorine-based surfactant in an amount within a range of from 0.0020 to 0.080 wt. % and component (2) one or more selected from polyhydric alcohol and polyalkyleneglycol and monoalkylether derivatives thereof (hereinafter collectively referred to as "glycol-based solvent") in an amount within a range of from 0.10 to 3.0 wt. %. Addition of a fluorine-based surfactant and a glycol-based solvent display a sufficient effect for preventing occurrence of film blurs and addition of both, together ensures a more remarkable effect.

As described above, both the fluorine-based surfactant component (1) above and the glycol-based solvent before dilution may be present. Therefore, if the original solution (i.e., the conductive film forming composition of the invention) contains at least any one of the fluorine-based surfactant, component (1) above and the glycol-based solvent component (2) above and the concentration thereof after dilution is within the specified range, the diluted coating solution can be used as it is. However, when the original solution does not contain any component (1) and component (2) or contains any of them but the concentration thereof after dilution is under the specified range, it is desirable to add at least one of component (1) or component (2) to the coating solution to be present in a range within the specified range in the coating solution.

The content of the fluorine-based surfactant in the diluted coating solution should preferably be within a range of from 0.0025 to 0.060 wt. %, or more preferably, from 0.0025 to 0.040 wt. %. Then content of the glycol-based solvent should preferably be within a range of from 0.15 to 2.5 wt. %, or more preferably, from 0.50 to 2.0 wt. %.

The lower conductive film formed by coating the diluted coating solution and the upper silica-based film can be formed in the same manner as in the just preceding case. The thickness of the upper and the lower films may be the same as those in the just preceding case. Similarly, a silica-based fine concave-convex layer may be formed by spraying a silica precursor solution onto the double-layered film.

When the coating material used for forming the lower conductive layer does not contain a binder (alkoxysilane) in the invention, a transparent conductive film comprising substantially a fine metal powder formed through coating of this coating material and drying has a whole visible light transmittance of at least 60% in general. However, since this fine metal powder film does not seem as being transparent in exterior view because of a high reflectivity intrinsic to a metal film, it is not suitable for application in a CRT or in a image display section of a display unit.

As to conductivity of this fine metal powder film, the surface resistance value does not decrease to below $1\times10^3\Omega/\square$ by forming through coating and drying alone, in spite of the absence of a binder, but increases to over $1\times10^5\Omega/\square$ in many cases. When desiring to achieve a lower resistance as represented by a surface resistance of up to $1\times10^3\Omega/\square$, it suffices to heat-treat the fine metal powder film at a temperature of at least 250° C. The heat treatment temperature more preferably is with a range of from 250 to 450° C. The heat treatment may usually be carried out in the open air. For an easily oxidizable metal, however, it may sometimes be necessary to conduct a heat treatment in a non-oxidizing atmosphere such as an inert gas. Through this heat treatment, communication between fine metal powder particles is improved to improve conductivity and it is, thus, possible to reduce the surface resistance to below $1\times10^3\Omega/\square$ or more preferably to below $1\times10^2\Omega/\square$.

The resultant fine metal powder film is applicable as a high-reflectivity transparent conductive film for wind glasses and automobile glasses, or for decoration of a show-window and glass partition. It is also useful, as a conductive paste, for manufacturing a conductive circuit of a transparent electrode for display.

Having generally described this invention, a further understanding can be obtained by reference to certain specific examples which are provided herein for purposes of illustration only and are not intended to be limiting unless otherwise specified. The Examples below are also disclosed in the priority document Hei 9-241410 filed Sep. 5, 1997, which is incorporated herein for its entirety. In the following examples, % means weight percentage unless otherwise specified.

EXAMPLES

Example 1

Example 1 covers formation of a double-layered film containing a black powder, using a lower layer forming coating material net containing a binder.

Lower Layer Forming Coating Material

A lower layer forming coating material, not containing alkoxysilane, was prepared by adding a fine metal powder and a black powder of kinds and at a ratio shown in Table 1 and, as required, a titanium compound of a kind and at a ratio shown in Table 1, to a mixed solvent of isopropanol/2-iso-propoxyethanol mixed at a weight ratio of 80/20 and mixing the resultant mixture in a paint shaker with zirconia beads having a diameter of 0.3 mm to cause dispersion of the two kinds of powder into the solvent. The fine metal powder and the black powder in the coating material had both an average primary particle size of up to 0.1 μm. The coating material contained these two kinds of powder in a total amount within a range of from 0.7 to 3.2% and had a viscosity within a range of from 1.0 to 1.6 cps.

The symbols for the titanium compounds used in Table 1 have the following meanings:

a: Isopropyltris (dioctylpyrophosphate) titanate;

b: Tetra (2,2-diaryloxymethyl-1-butyl) bis(di-tridesyl) phosphate titanate;

c: Bis (dioctylpyrophosphate) oxyacetate titanate.

For comparison purposes, a coating material containing the following ITO powder or ATO powder in place of the fine metal powder was prepared in a similar manner.

ITO powder: Sn doping: 5 mol. %, average primary particle size: 0.02 μm (all particle sizes were measured by electron microscopy unless otherwise specified);

ATO powder: Sn doping: 5 mol. %, average primary particle size: 0.02 μm.

Upper Layer Forming Coating Material

Silica sol was synthesized through hydrolysis of ethoxysilane (ethyl silicate) by heating the same in ethanol containing a slight amount of hydrochloric acid and water at 60° C. for an hour. The resultant silica sol solution was diluted with a mixed solvent of ethanol/isopropanol/butanol mixed at a weight ratio of 5:8:1 to prepare a coating material having a concentration as converted into $SiO_2$ of 0.70%, and a viscosity of 1.65 cps.

Film Forming Method

A film was formed by sequentially dropping the lower layer forming coating material and the upper layer forming coating material by means of a spin coater onto a side of a substrate comprising a soda lime glass (blue plate glass) plate having dimensions of 100 mm×100 mm×thickness of 3 mm, under conditions including a dropping amount of 5 to 10 g, revolutions of 140 to 180 rpm and a rotation time of 60 to 180 seconds for both coating materials. Then, a transparent black conductive film was formed on the glass substrate by baking the coated film by heating the substrate at 170° C. for 30 minutes in the open air. The properties of the resultant film were evaluated as follows.

Evaluation of Film Properties

Thickness: Thickness of each layer was measured from SEM cross-section

Surface resistance: Measured by the four-probe method (ROLESTER AP: made by Mitsubishi Petrochemical co., Ltd.)

Light transmittance (whole visible light beam transmittance): Measured with a recording spectrophotometer (Model U-4000: made by Hitachi Limited)

Haze: Measured with a haze meter (HGM-3D: made by Suga Tester Manufacturing Co.)

Visible light minimum reflectance: a black vinyl tape (No. 21: made by Nitto Electric Co.) was pasted onto the back of the glass substrate. After keeping the substrate at a temperature of 50° C. for 30 minutes to form a black mask, reflection spectrum of the visible region wavelength in a 12° C. regular reflection with a recording spectrophotometer. The minimum value of reflectance at a high visibility of 500 to 600 nm was determined from the resultant spectrum and the result was recorded as the minimum reflectance.

Figure 3A:
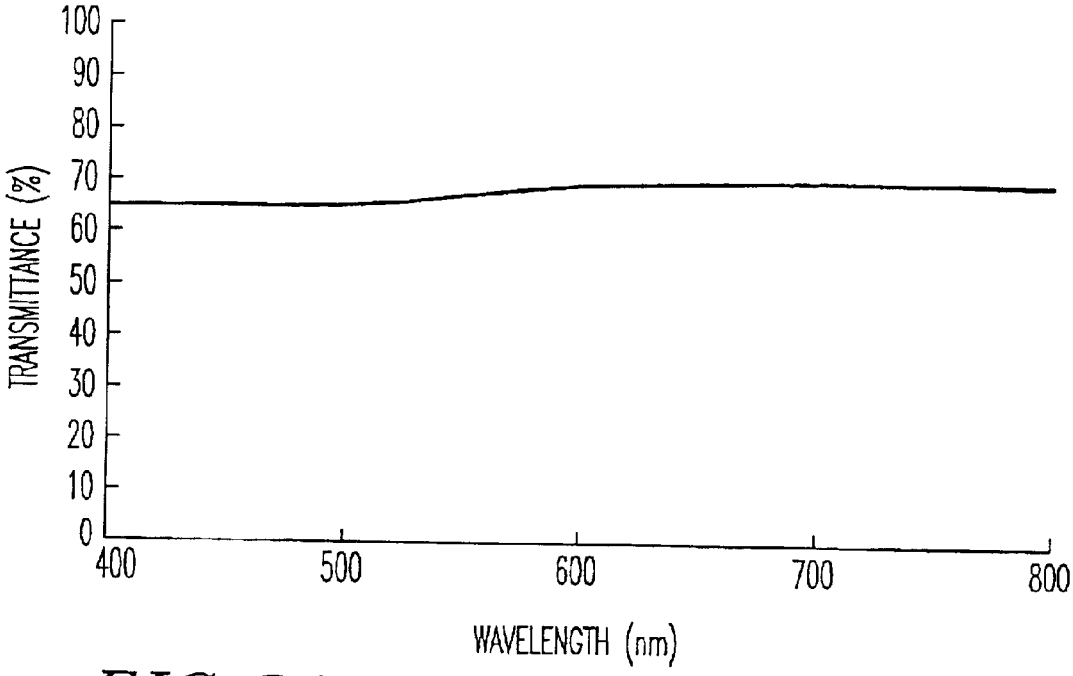
FIGS. 3A and 3B are transmission spectrum and a reflection spectrum, respectively, of a transparent blackish conductive film of the invention prepared in an embodiment.
Figure 3B:
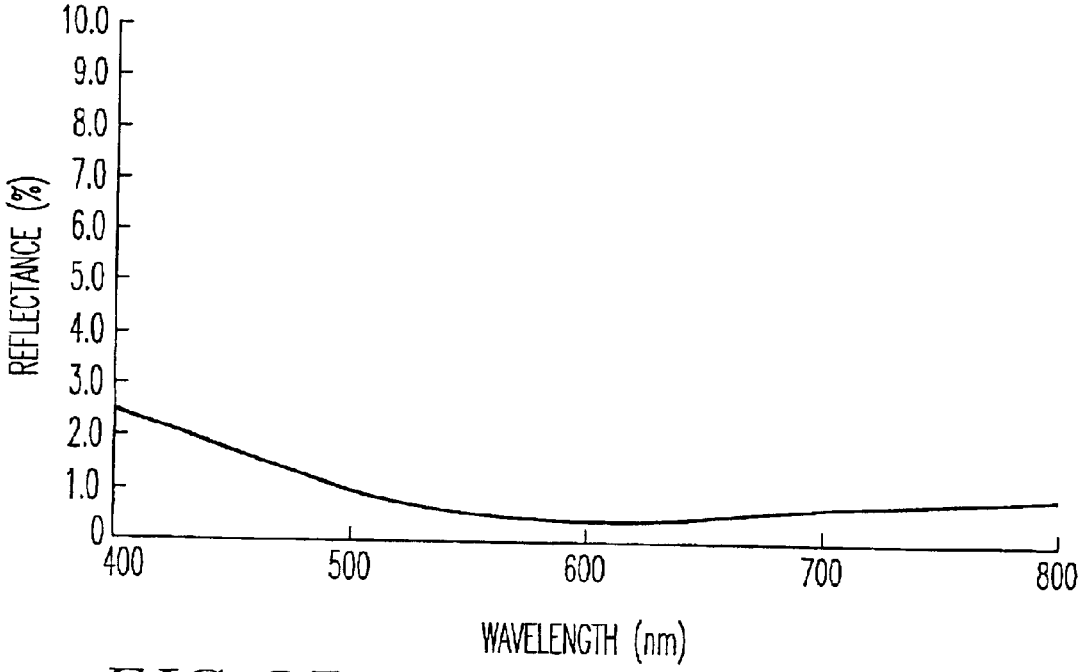
Figure 4A:
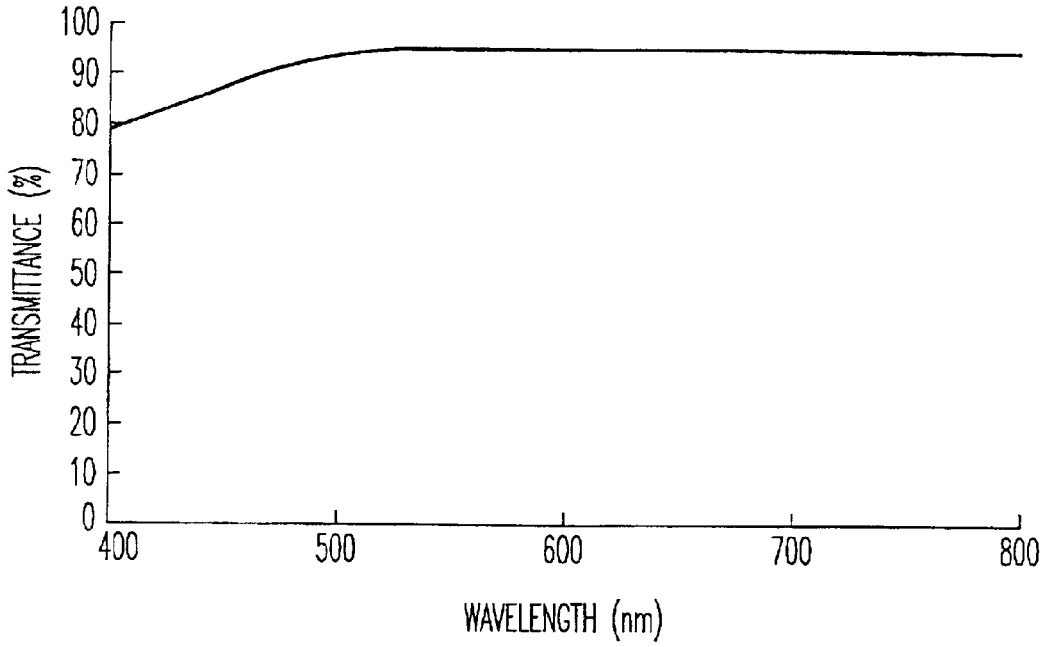
FIGS. 4A and 4B are a transmission spectrum and reflection spectrum, respectively, of a transparent blackish conductive film for comparison prepared in the aforesaid embodiment.
Figure 4B:
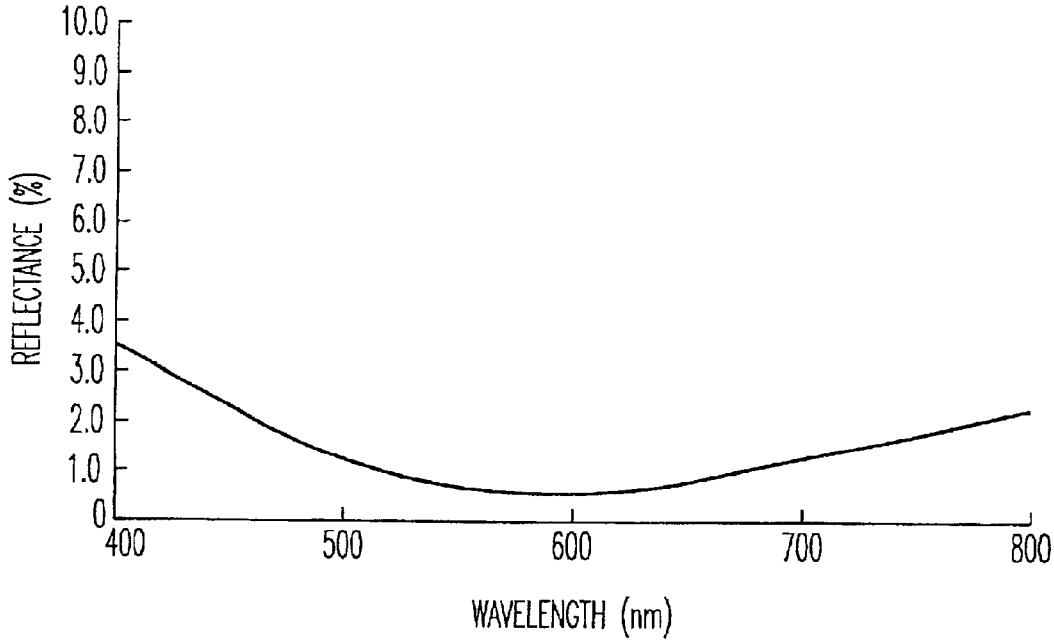

The results of the foregoing tests are comprehensively shown in Table 1. A transmission spectrum and a reflection spectrum of the transparent black conductive film (containing a fine Ag powder and a titanium black powder) of the example of the invention of Test No. 7 are illustrated in FIGS. 3A and 3B. A transmission spectrum and a reflection spectrum of the transparent black conduction film (containing an ITO powder and a titanium black powder) of the comparative example of Test No. 13 an illustrated in FIGS. 4A and 4B.

In this example of the invention, as is clear from Table 1, in spite of the broad range of thickness from about 65 to 600 nm of the lower conductive layer (it may sometimes deviate largely from λ/4), the resultant conductive film has a visible light minimum reflectance of up to 1%, a haze of up to 1% and a whole visible light transmittance of at least 60% and is excellent in visual recognition, with a low reflectivity. The surface resistance of the film varies largely in a wide range of from $10^0\Omega/\square$ to $10^5\Omega/\square$, depending upon the kind of fine metal powder and the ratio thereof to black powder. That is, it is possible to change conductivity of the film in response to the required electromagnetic wave shielding property and there is available a transparent black conductive film of a very low resistance, having a surface resistance of $10^0$ to $10^1\Omega/\square$ sufficient to satisfy a strict electromagnetic wave shielding property.

In the case where an ITO powder was used as a conductive powder, in contrast, although transparency is high, conductivity is low as represented by a surface resistance of $10^3\Omega/\square$ at the highest and cannot satisfy the requirement for a strict electromagnetic wave shielding property. In the case where an ATO powder was used, the surface resistance is very high as $10^6\Omega/\square$: it is possible to impart an electrification preventing ability but not to display electromagnetic wave shielding property.

The transmission spectrum of the transparent black conductive film (the conductive powder is Ag powder) of the example of the invention shown in FIG. 3A reveals that the film is blackish because substantially a contact transmittance is kept at about 65% throughout the entire visible region. Comparison of the reflection spectrum of the transparent black conductive film shown in FIG. 3B and the reflection spectrum of the comparative example (the conductive powder is ITO powder) shown in FIG. 4B demonstrates that the reflectance near 400 nm and 800 nm at the end of the visible region is lower in the comparative example than in the conductive film of the example of the invention and the visibility improving effect brought about by the low reflectivity is more remarkable than in the use of the ITO powder.

TABLE 1

| Division | Test No. | Composition of lower layer forming coating material (in weight parts; balance is a solvent): Fine metal powder Kind | Fine metal powder Weight parts | Black powder Kind[1] | Black powder Weight parts | Total powder in wt. % | Titanium compound Kind | Titanium compound wt %[2] | Film thickness (nm): Lower conductive layer | Film thickness (nm): Upper silica layer | Film properties: Surface resistance (Ω/□) | Film properties: Optical transmittance (%) | Film properties: Haze (%) | Film properties: Minimum reflectance (%) |
|---|---|---|---|---|---|---|---|---|---|---|---|---|---|---|
| Example of Invention | 1 | Cu | 95 | $TiO_{0.80}N_{0.04}$ | 5 | 2.8 | a | 1.0 | 530 | 85 | $1.5 \times 10^3$ | 75.5 | 0.6 | 0.98 |
| | 2 | Cu—Ag[3] | 85 | $TiO_{0.80}N_{0.04}$ | 15 | 3.1 | None | — | 600 | 65 | $7.0 \times 10^2$ | 68.8 | 0.7 | 0.95 |
| | 3 | Ni | 77 | $TiO_{0.80}N_{0.04}$ | 23 | 3.2 | b | 2.0 | 220 | 70 | $5.5 \times 10^3$ | 69.5 | 0.8 | 0.91 |
| | 4 | Ni—Ag[4] | 80 | $TiO_{0.80}N_{0.04}$ | 20 | 1.8 | None | — | 280 | 75 | $8.5 \times 10^2$ | 60.8 | 0.7 | 0.93 |
| | 5 | W/Ag[5] | 85 | $TiO_{1.21}N_{0.08}$ | 15 | 2.2 | c | — | 210 | 80 | $1.0 \times 10^3$ | 63.3 | 0.6 | 0.90 |
| | 6 | Ag—Pd/ATO[6] | 20 | $TiO_{1.21}N_{0.08}$ | 80 | 2.0 | c | 0.1 | 70 | 95 | $2.1 \times 10^4$ | 81.1 | 0.4 | 0.76 |
| | 7 | Ag | 80 | $TiO_{1.05}N_{0.04}$ | 20 | 2.4 | None | 0.1 | 92 | 105 | $1.3 \times 10^9$ | 68.8 | 0.3 | 0.68 |
| | 8 | Ag | 65 | $TiO_{1.05}N_{0.04}$ | 35 | 1.4 | None | — | 84 | 95 | $3.5 \times 10^3$ | 80.5 | 0.3 | 0.78 |
| | 9 | Ag | 83 | Magnetite | 17 | 1.6 | None | — | 68 | 90 | $7.5 \times 10^2$ | 71.8 | 0.4 | 0.71 |
| | 10 | Ag | 70 | Carbon black | 30 | 1.8 | None | — | 105 | 85 | $6.6 \times 10^2$ | 70.1 | 0.3 | 0.77 |
| | 11 | Au—Pd[7] | 5 | $TiO_{1.21}N_{0.08}$ | 95 | 0.7 | None | — | 65 | 90 | $6.1 \times 10^5$ | 77.8 | 0.3 | 0.85 |
| Comparative example | 12 | ITO | 100 | None | — | 1.7 | None | — | 95 | 90 | $9.8 \times 10^3$ | 96.8 | 0.1 | 0.81 |
| | 13 | ITO | 85 | $TiO_{1.08}N_{0.01}$ | 15 | 2.2 | None | — | 80 | 85 | $5.5 \times 10^4$ | 97.0 | 0.2 | |
| | 14 | ATO | 88 | $TiO_{1.08}N_{0.01}$ | 12 | 2.0 | None | — | 110 | 90 | $7.6 \times 10^6$ | 86.7 | | 0.8 |

(Note)
[1]Titanium black is represented by content of TiOxNy.
[2]Weight % to the total amount of fine metal powder and black powder.
[3]Cu-45 wt. % Ag alloy
[4]Ni-68 wt. % Ag alloy
[5]Mixed powder of 28 wt. % W and 72 wt. % Ag
[6]Mixed powder of 70 wt. % Ag-60 wt. % Pd alloy and 30 wt. % ATO
[7]Au-20% Pd alloy

Example 2

Example 2 covers formation of a double-layered film having a lower conductive layer containing a black powder, using a lower layer forming coating material containing a binder.

Lower Layer Forming Coating Material

The details of this example were the same as in Example 1 except that tetraethoxysilane (ethylsilicate) was added as a binder in a ration as converted into $SiO_2$ of 10 weight parts relative to 10 weight parts total amount of the fine metal powder and the black powder and a slight amount of hydrochloric acid was added as a catalyst for hydrolysis.

Upper Layer Forming Coating Material

Same as in Example 1.

Film Forming Method

The process was the same as in Example 1 except that, after coating the lower layer forming coating material onto the substrate by means of a spin coater, the coated substrate was heated in the open air at 50° C. for five minutes to accomplish baking of the lower layer before coating the upper layer forming coating material by the spin coater.

The film structure and the test results of the thus obtained double-layered black conductive fine powder are comprehensively shown in Table 2. It is known from Table 2 that even when the lower layer forming coating material contains a binder, a transparent black conductive film having similar properties as those in Example 1 is available.

TABLE 2

| Division | Test No. | Composition of lower layer forming coating material (in weight parts; balance is a solvent): Fine metal powder Kind | Fine metal powder Weight parts | Black powder Kind[1] | Black powder Weight parts | Total powder in wt. % | Ethyl silicate wt %[2] | Titanium compound Kind | Titanium compound wt %[3] |
|---|---|---|---|---|---|---|---|---|---|
| Example of Invention | 1 | Ag | 80 | $TiO_{0.05}N_{0.04}$ | 20 | 1.4 | 0.14 | None | — |
| | 2 | Ag | 85 | Carbon black | 15 | 1.6 | 0.16 | c | 0.10 |
| | 3 | Ag | 90 | $TiO_{0.08}N_{0.04}$ | 10 | 1.0 | 0.10 | None | — |

| Division | Test No. | Film thickness: Lower conductive layer | Film thickness: Upper silica layer | Film properties: Surface resistance (Ω/□) | Film properties: Optical transmittance (%) | Film properties: Haze (%) | Film properties: Minimum reflectance (%) |
|---|---|---|---|---|---|---|---|

TABLE 2-continued

| | | | | | | | |
|---|---|---|---|---|---|---|---|
| Example of Invention | 1 | 54 | 85 | $1.8 \times 10^3$ | 61.2 | 0.7 | 0.51 |
| | 2 | 68 | 80 | $8.6 \times 10^2$ | 60.8 | 0.4 | 0.38 |
| | 3 | 52 | 82 | $2.0 \times 10^3$ | 64.1 | 0.6 | 0.39 |

(Note)
[1]Titanium black is represented by content of $TiO_xN_y$.
[2]Wt. % as converted into $SiO_2$
[3]Weight % to the total amount of fine metal powder and black powder.

Example 3

Lower Layer Forming Coating Material

A lower layer forming coating material not containing alkoxysilane was prepared by adding a fine metal powder to a solvent containing a surfactant or a polymer dispersant and dispersing the fine metal powder in the solvent by mixing the mixture with zirconia beads having a diameter of 0.3 mm in a paint shaker. The kinds of the fine metal powder, the additive, and the solvent used an the amount thereof in the coating material were as shown in Table 3. The fine metal powder was prepared by the colloidal technique (reducing a metal compound through reaction with a reducing agent in the presence of a protecting colloid). The average primary particle size thereof is shown also in Table 3. The symbols for the additives and the solvent (figures in parentheses are weight ratios) have the following meanings:

Additives:

A: Stearyltrimethylammonium chloride

B: Sodium dodecylbenzenesulfonate

C: Polyvinylpyroridone (K-30 made by Kanto Kagaku Co.)

Solvents:

1) Water/propylene glycolmethylether/4-hydroxy-4-methyl-2-pentanone (85/10/5)

2) Methanol/isopropylglycol (71/29)

3) Water/propyleneglycolmethylether (98.5/1.5)

4) Ethanol/isopropylglycol/propyleneglycolmethyl-ether/4-hydroxy-4-methyl-2-pentanone (84/1.5/5/9.5)

5) Ethanol (100)

6) Water/propyleneglycolmethylether (68/32)

Upper Layer Forming Coating Material

Ethylsilicate was hydrolyzed in the same manner as in Example 1. The resultant silica sol solution was diluted with a mixed solvent of ethanol/isopropanol/butanol mixed at a weight ratio of 5:8:1, thereby preparing a coating material having a concentration as converted into $SiO_2$ of 1.0% and a viscosity of 1.65 cps.

Film Forming Method

A transparent conductive film was formed on a glass substrate by the spin coat method in the same manner as in Example 1 except for a rotation time of 60 to 150 seconds. The properties of the resultant film were evaluated as follows. The results are shown together in Table 3.

Evaluation of Film Properties

The average area of pores in the net structure of the secondary particles of fine metal powder and the occupation ratio: measured from TEM photograph of the upper surface of the film.

Close adherence: using a rubber eraser ER-20R made by Lion Co., the status of flaws was visually observed after 50 runs of reciprocation under a load of 1 kgf/cm$^2$ with a stroke of 5 cm. The symbol ○ means absence of flaws and x presence of flaws.

Visible light minimum reflectance: The reflection spectrum of the visible region wavelength was measured as described in Example 1. The minimum value of reflectance (the lowest reflectance) and values of reflectance at 400 nm and 800 nm were determined from the reflection spectrum. The result is shown in Table 3 together with the wavelength corresponding to the lowest reflectance.

The measuring method of thickness, surface resistance, light transmittance (whole visible light transmittance) and haze were the same as those presented in Example 1.

Figure 5:
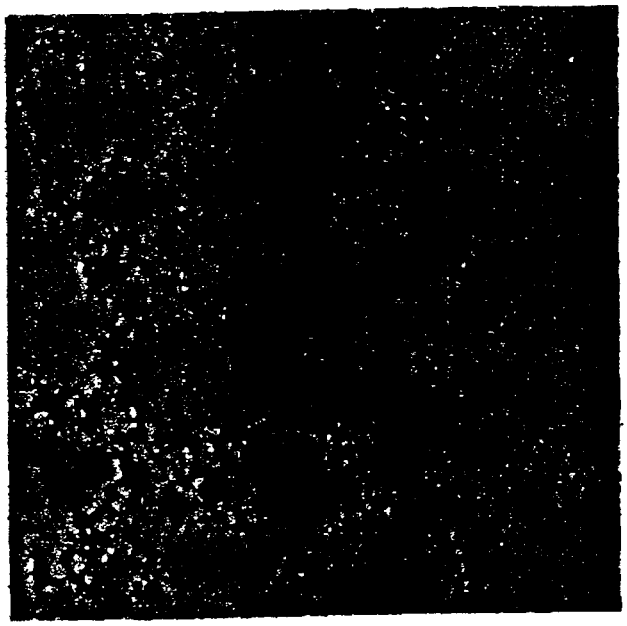
FIG. 5 is a TEM photograph of a transparent conductive film of the invention prepared in another embodiment.
Figure 7:
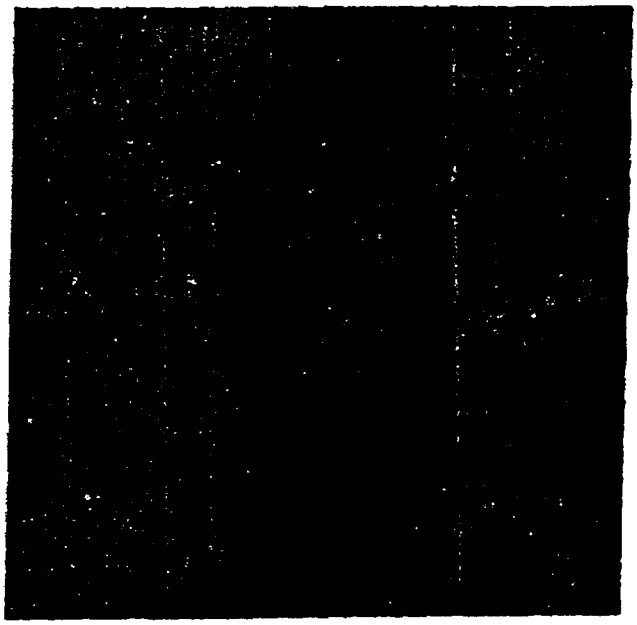
FIG. 7 is a TEM photograph of a transparent conductive film for comparison prepared in the foregoing another embodiment.
Figure 6A:
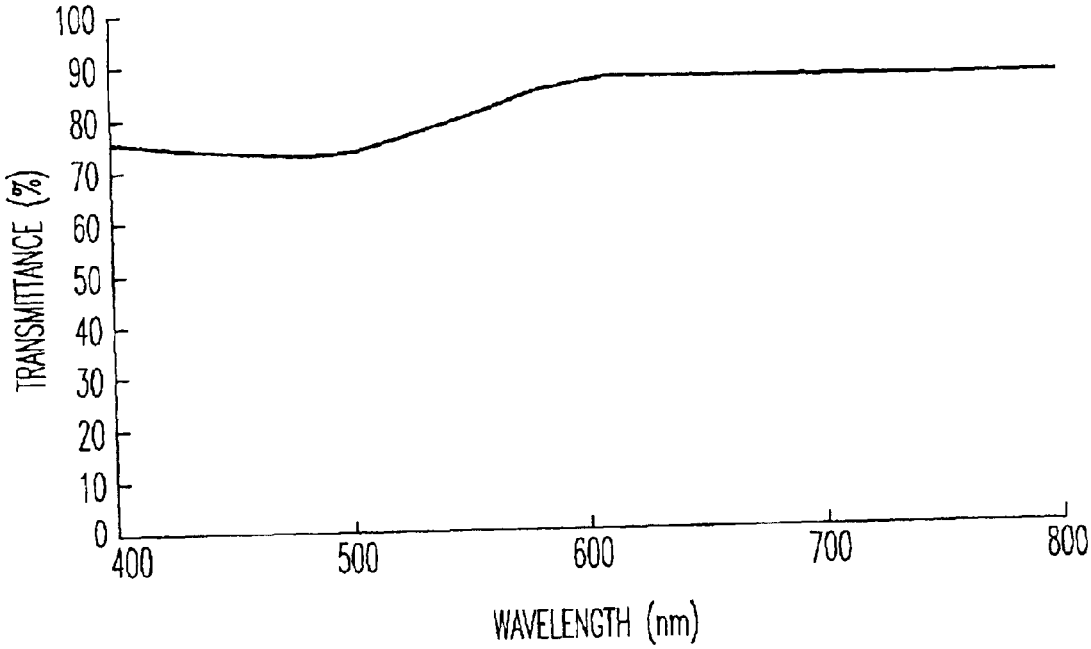
FIGS. 6A and 6B are a transmission spectrum and a reflection spectrum, respectively, of the transparent conductive film of the invention prepared in the foregoing another embodiment.
Figure 6B:
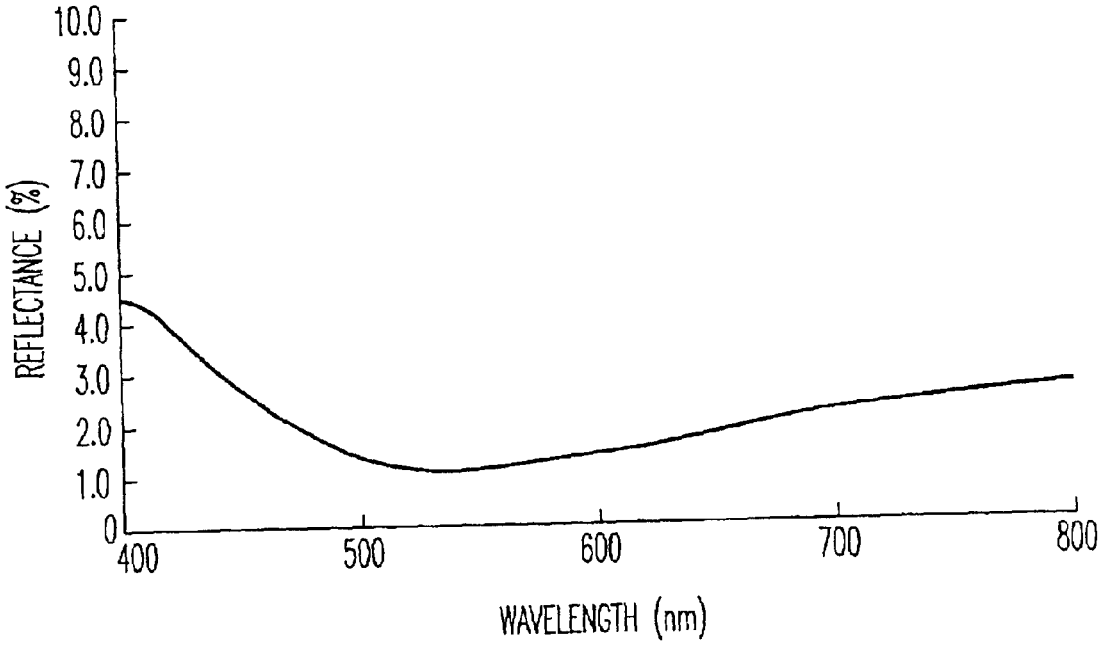
Figure 8A:
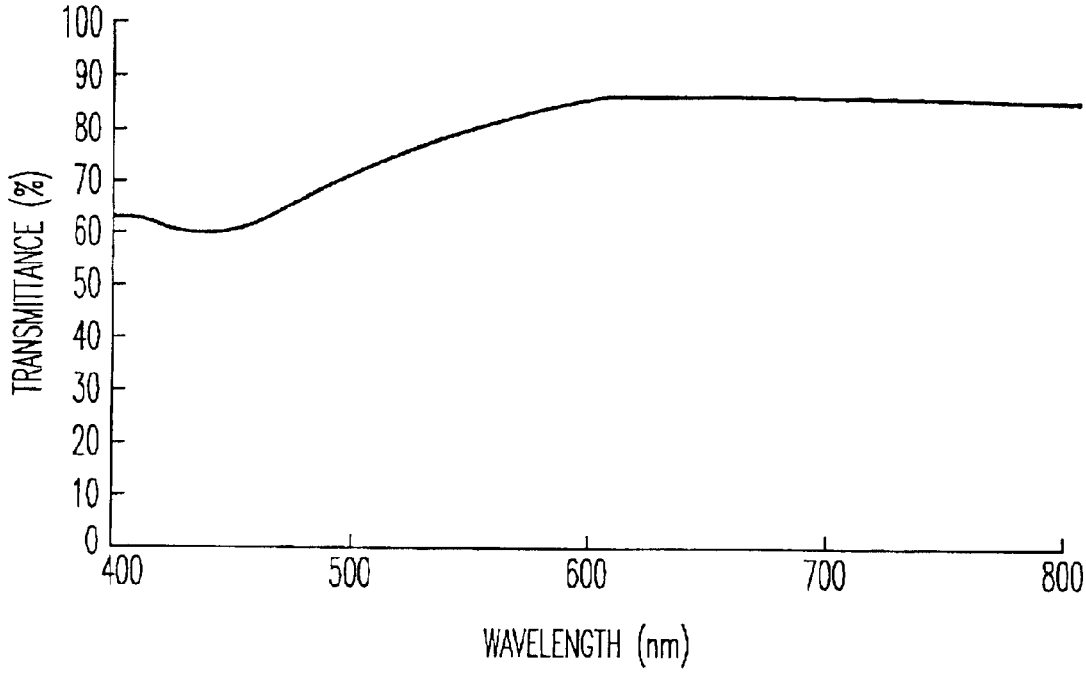
FIGS. 8A and 8B are a transmission spectrum and a reflection spectrum, respectively, of the foregoing transparent conductive film for comparison.
Figure 8B:
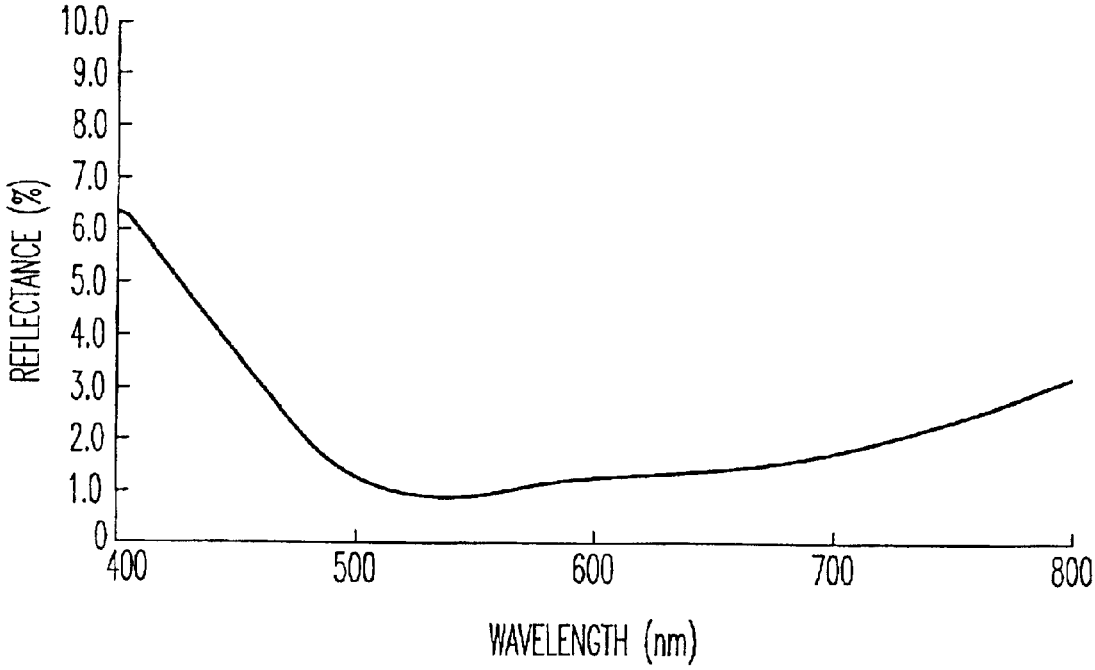

A TEM photograph of the surface of the transparent conductive film of Test 2 of the example of the invention is shown in FIG. 5. The transmission spectrum and the reflection spectrum thereof are shown in FIGS. 6A and 6B, respectively. A TEM photograph of the surface of the transparent conductive film of the comparative example in Test No. 11 is shown in FIG. 7. The transmission spectrum and the reflection spectrum thereof are shown in FIGS. 8A and 8B, respectively.

In this example of the invention, as is clear from Table 3, use of a coating material in which the fine metal powder having an average primary particle size within a range of from 2 to 30 nm is dispersed with a dispersant in a solvent satisfying particular conditions revealed that the secondary particles of the fine metal powder were distributed in the lower conductive layer, as shown in the TEM photograph of FIG. 5, so as to form a net structure and pores were present in this net structure.

However, the forming method of the transparent conductive film of the invention is not limited to the method presented in the example but the film may be formed by any method so far as such a method generates a similar net structure.

Although the fine metal powder particles were not uniformly distributed but formed a net structure of the secondary particles, the film showed a satisfactory close adherence.

TABLE 3

| | | Composition of dispersed solution (coating material) (balance is solvent) | | | | | | Film properties | | | |
|---|---|---|---|---|---|---|---|---|---|---|---|
| | | Fine metal powder | | | | | | Net structure | | Thickness (nm) | |
| Division | Test No. | Kind | wt % | Primary particle size (nm) | Additive Kind | Additive wt % | Kind of solvent | Average pore area (nm$^3$) | Pore occupancy (%) | Lower layer | Upper layer |
| Example of Invention | 1 | Ag | 2.6 | 29 | A | 0.005 | 1) | 2,590 | 32 | 126 | 88 |
| | 2 | | 1.5 | 7 | | | 2) | 17,085 | 58 | 70 | 86 |

TABLE 3-continued

| | | | | | | | | | | | |
|---|---|---|---|---|---|---|---|---|---|---|---|
| | 3 | | 1.8 | 17 | | 0.002 | 3) | 9,723 | 47 | 82 | 72 |
| | 4 | | 2.0 | 23 | B | | 1) | 2,953 | 41 | 98 | 81 |
| | 5 | | 2.5 | 10 | | 0.004 | | 3,015 | 40 | 116 | 92 |
| | 6 | Ag/Pd[1] | 2.0 | 18 | | | | 15,270 | 54 | 92 | 86 |
| | 7 | Ag/Cu[2] | 2.0 | 27 | | | | 2,725 | 38 | 104 | 84 |
| | 8 | Au | 1.0 | 2 | | | 4) | 29,580 | 67 | 28 | 92 |
| | 9 | Pd/Pt[3] | 2.2 | 8 | C | 0.005 | 1) | 26,968 | 69 | 49 | 95 |
| | 10 | Ni—Ag[4] | 3.0 | 25 | | | | 16,017 | 56 | 146 | 90 |
| Comparative | 11 | Ag | 1.5 | 5 | A | 0.005 | 5) | —[5] | — | 68 | 88 |
| example | 12 | | 2.5 | 60 | | | 1) | —[5] | — | 78 | 83 |
| | 13 | Au | 1.0 | 6 | | | 6) | —[5] | — | 22 | 94 |

| | | Film properties | | | | | | | | |
|---|---|---|---|---|---|---|---|---|---|---|
| | | | | | Reflectance | | | | | |
| | | | | | Minimum reflectance | | | | | |
| Division | Test No. | Surface resistance (Ω × □) | Visible light transmittance (%) | Haze (%) | Wavelength (nm) | (%) | 400 nm (%) | 800 nm (%) | Contact strength | Score |
| Example of | 1 | $1.0 \times 10^2$ | 60 | 0.7 | 530 | 0.9 | 3.8 | 2.8 | ○ | ○ |
| Invention | 2 | $5.0 \times 10^2$ | 84 | 0.6 | 528 | 0.6 | 4.3 | 2.7 | ○ | ○ |
| | 3 | $3.8 \times 10^2$ | 71 | 0.6 | 520 | 0.6 | 4.7 | 2.6 | ○ | ○ |
| | 4 | $2.1 \times 10^2$ | 66 | 0.7 | 522 | 0.7 | 4.2 | 2.7 | ○ | ○ |
| | 5 | $4.0 \times 10^2$ | 65 | 0.8 | 542 | 0.9 | 3.7 | 2.5 | ○ | ○ |
| | 6 | $2.2 \times 10^3$ | 78 | 0.8 | 530 | 0.8 | 3.8 | 2.8 | ○ | ○ |
| | 7 | $4.2 \times 10^2$ | 61 | 0.7 | 530 | 0.8 | 3.9 | 2.9 | ○ | ○ |
| | 8 | $8.9 \times 10^2$ | 88 | 0.6 | 540 | 0.3 | 5.8 | 3.0 | ○ | ○ |
| | 9 | $4.2 \times 10^3$ | 87 | 0.5 | 545 | 0.5 | 5.1 | 2.8 | ○ | ○ |
| | 10 | $4.6 \times 10^2$ | 78 | 0.6 | 538 | 0.9 | 3.1 | 2.9 | ○ | ○ |
| Comparative | 11 | $4.2 \times 10^5$ | 81 | 0.8 | 536 | 0.6 | 6.4 | 3.2 | ○ | X |
| example | 12 | $6.1 \times 10^4$ | 40 | 1.8 | 530 | 0.8 | 6.6 | 3.4 | X | X |
| | 13 | $5.1 \times 10^4$ | 47 | 0.6 | 545 | 0.3 | 8.2 | 3.5 | ○ | X |

(Note)
[1]Pb/3% Ag mixed powder
[2]Cu/4% Ag mixed powder
[3]Pb/5% Pt mixed powder
[4]Ni-68% Ag alloy
[5]Net structure not formed

Example 4

Lower Layer Forming Coating Material

A lower layer forming coating material not containing alkoxysilane was prepared in the same manner as in Example 3. The kinds of the fine metal powder, the dispersant, and the solvent used and the amounts thereof in the coating material were as shown in Table 4.

The fine metal powder used was prepared by the colloidal technique (reducing a metal compound through reaction with a reducing agent in the presence of a protecting colloid). The average primary particle size (measured by TEM (transmission electron microscope)) and the particle size distribution of the secondary particles in the coating material (dispersed solution) (10%, 50% and 90% cumulative particle sizes, measured with a UPA particle size analyzer (made by Nikki Equipment Mfg. Co.)) are shown also in Table 4.

The symbols for the dispersant and the solvent (figures in parentheses are weight ratios) shown in Table 4 have the following meanings:

Additives:

A: Stearyltrimethylammonium chloride:

B: Sodium dodecylbenzenesulfonate;

C: Polyvinylpyrrolidine (K-30 made by Kanto Kagaku Co.);

Solvents:

1) Ethanol/methylcellosolve (85/15);
2) Methanol/methylcellosolve (80/20);
3) Water/butylcellosolve (90/10);
4) Ethanol/methanol/butylcellosolve (80/10/10);
5) Ethanol (100);
6) Water/ethanol/butylcellosolve (80/10/10).

Upper Layer Forming Coating Material

A coating material having an $SiO_2$-converted concentration of 0.7% and a viscosity of 1.65 cps by diluting a silica sol solution obtained through hydrolysis of ethylsilicate in the same manner as in Example 1 with a mixed solvent of ethanol/isopropanol/butanol at a weight ratio of 5:8:1.

Film Forming Method

A double-layered transparent conductive film was formed on a glass substrate in the same manner as in Example 3. Properties of the resultant film were evaluated as follows. These results are shown also in Table 4.

Evaluation of Film Properties

Average thickness and average pitch of concave and convex portions of the surface irregularities of the lower layer (layer containing fine metal powder) and upper layer thickness (average thickness from the lower layer convex portion): measured on a TEM cross-section.

Close adherence, surface resistance, light transmittance (whole visible light transmittance), haze, and visible light reflectance were measured in the same manner as in Example 3.

Figure 9A:
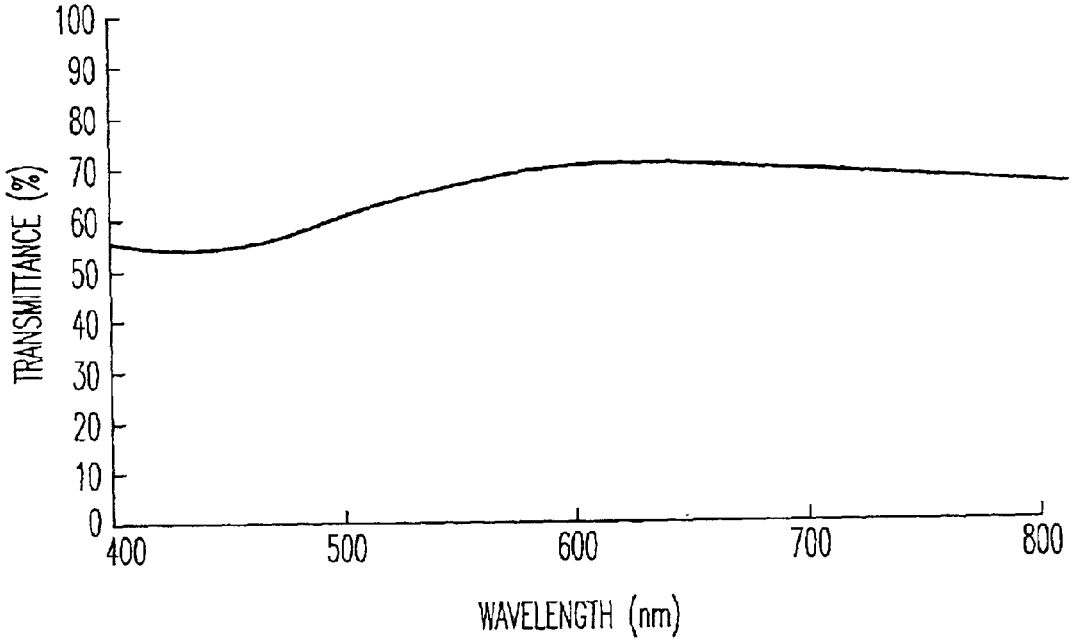
FIGS. 9A and 9B are a transmission spectrum and a reflection spectrum, respectively, of a transparent conductive film of the invention prepared in another embodiment.
Figure 9B:
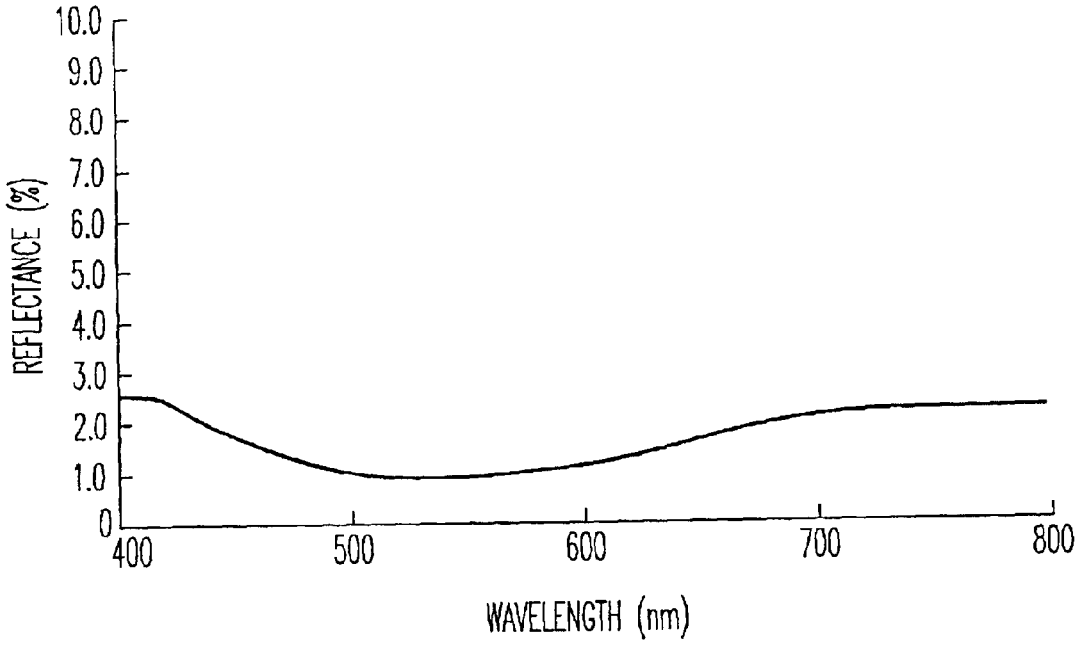
Figure 10A:
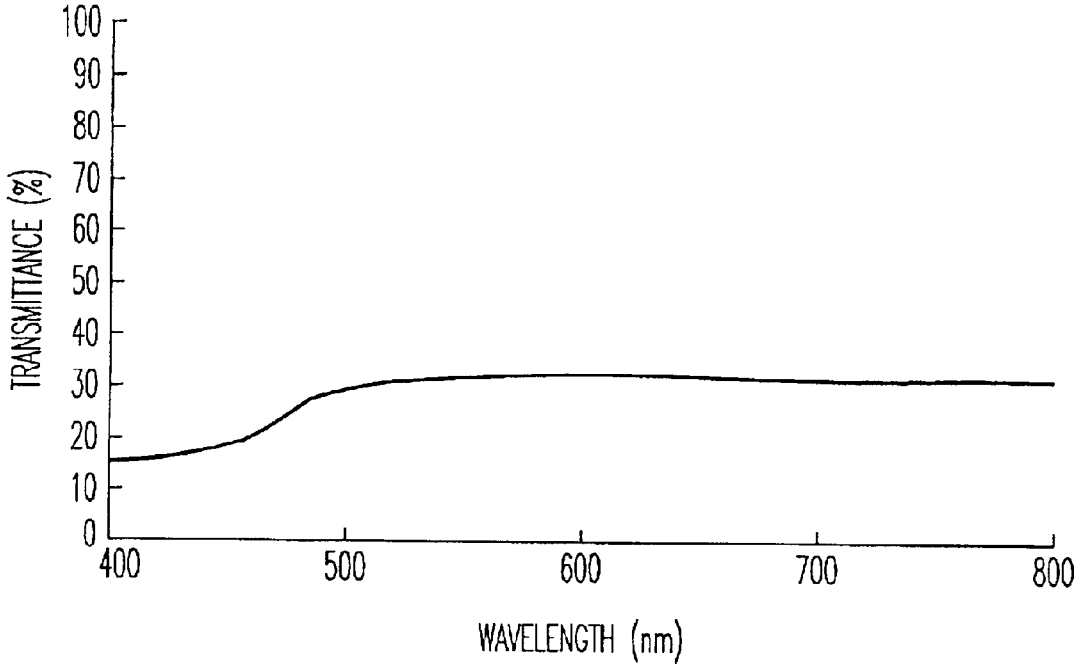
FIGS. 10A and 10B are a transmission spectrum and a reflection spectrum, respectively, of a transparent conductive film for comparison prepared in the foregoing another embodiment.
Figure 10B:
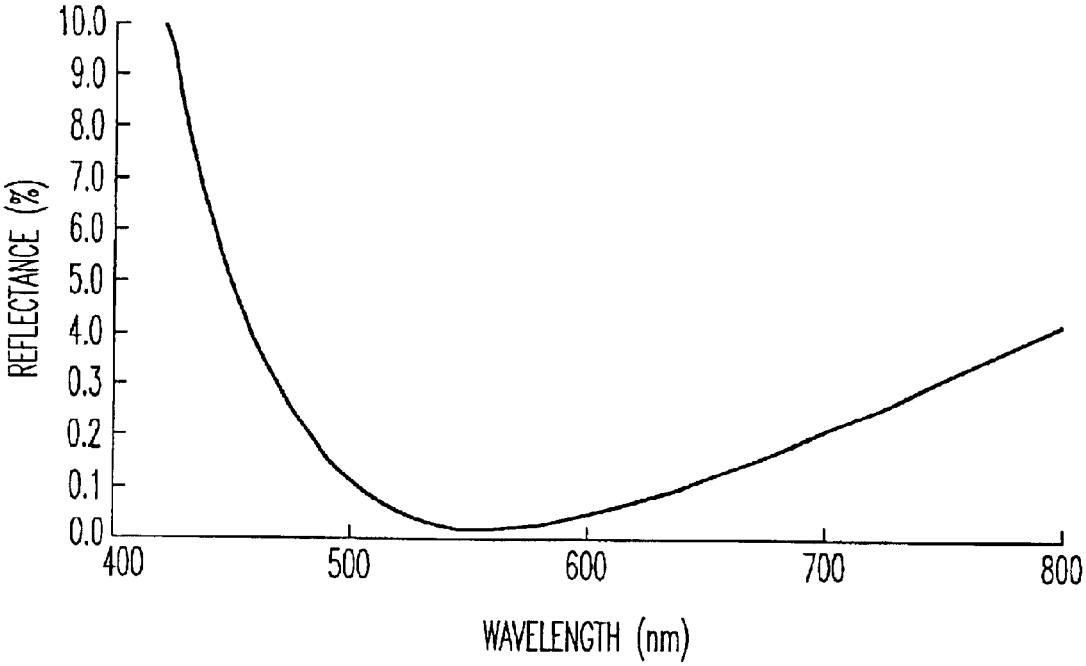

A transmission spectrum and a reflection spectrum of the transparent conductive film of the example of the invention in Test No. 4 are shown in FIGS. 9A and 9B, respectively. A transmission spectrum and a reflection spectrum of the transparent conductive film of the comparative example in Test No. 11 are shown in FIGS. 10A and 10B, respectively.

TABLE 4

| | | Composition of dispersed solution (coating material) | | | | | | | | | | | Lower layer surface shape (nm) | | |
|---|---|---|---|---|---|---|---|---|---|---|---|---|---|---|---|
| | | Fine metal powder | | | | | | | | | | | | | |
| | Test | | | Primary particle size | Cumulative particle size (nm) | | | Dis-persant | | Solvent | | | Convex portion | Concave portion | Convex portion |
| Division | No. | Kind | % | (nm) | 10% | 50% | 90% | Kind | % | Kind | % | | thickness | thickness | pitch |
| Example of Invention | 1 | Ag | 2.8 | 20 | 40 | 70 | 120 | A | 0.004 | 1) | Balance | | 143 | 120 | 34 |
| | 2 | | 1.4 | 46 | 56 | 146 | 486 | | | 2) | Balance | | 72 | 38 | 293 |
| | 3 | | 1.7 | 18 | 22 | 82 | 146 | | 0.002 | 3) | Balance | | 88 | 62 | 180 |
| | 4 | | 2.2 | 21 | 26 | 86 | 280 | B | | 1) | Balance | | 112 | 73 | 58 |
| | 5 | | 2.7 | 12 | 20 | 62 | 108 | | 0.008 | | Balance | | 147 | 104 | 140 |
| | 6 | Au | 1.0 | 8 | 14 | 54 | 95 | | | | Balance | | 60 | 48 | 105 |
| | 7 | Ag/Pd[1] | 2.0 | 22 | 26 | 74 | 108 | | | | Balance | | 80 | 65 | 224 |
| | 8 | Ag/Cu[2] | 2.0 | 28 | 35 | 63 | 105 | | | 4) | Balance | | 86 | 71 | 26 |
| | 9 | Au-d[3] | 1.6 | 12 | 16 | 60 | 120 | C | 0.020 | 1) | Balance | | 68 | 58 | 68 |
| | 10 | Pt—Au[4] | 1.8 | 8 | 12 | 52 | 86 | | | | Balance | | 54 | 33 | 70 |
| Comparative example | 11 | Ag | 1.6 | 18 | 16 | 46 | 76 | A | 0.005 | 5) | Balance | | 92 | 82 | — |
| | 12 | | 1.9 | 56 | 18 | 68 | 126 | | | 1) | Balance | | 84 | 61 | 406 |
| | 13 | Au | 1.2 | 3 | 8 | 65 | 86 | | | 6) | Balance | | 64 | 57 | 250 |
| | 14 | | 1.0 | 8 | 10 | 157 | 492 | | | | Balance | | 160 | 76 | 350 |

| | | Film Properties | | | | | | | | | |
|---|---|---|---|---|---|---|---|---|---|---|---|
| | | | | | | Reflectance | | | | | |
| | Test | Upper layer thick- | Surface | Visible light transmittance | Haze | Minimum reflectance | | 400 nm | 800 nm | Contact | |
| Division | No. | ness % (nm) | resistance (Ω × □) | (%) | (%) | (nm) | (%) | (%) | (%) | strength | Score |
| Example of Invention | 1 | 84 | $4.2 \times 10^2$ | 60 | 0.8 | 532 | 0.9 | 3.2 | 2.7 | ○ | ○ |
| | 2 | 82 | $8.8 \times 10^2$ | 70 | 0.7 | 528 | 0.8 | 2.6 | 2.6 | ○ | ○ |
| | 3 | 86 | $6.8 \times 10^2$ | 72 | 0.6 | 540 | 0.7 | 2.8 | 2.5 | ○ | ○ |
| | 4 | 87 | $6.0 \times 10^2$ | 67 | 0.8 | 535 | 0.7 | 2.6 | 2.3 | ○ | ○ |
| | 5 | 90 | $3.2 \times 10^2$ | 58 | 0.6 | 548 | 1.0 | 2.8 | 2.5 | ○ | ○ |
| | 6 | 98 | $2.1 \times 10^2$ | 75 | 0.6 | 555 | 0.4 | 3.8 | 2.6 | ○ | ○ |
| | 7 | 68 | $8.2 \times 10^2$ | 68 | 0.8 | 522 | 0.6 | 2.7 | 2.4 | ○ | ○ |
| | 8 | 75 | $8.8 \times 10^2$ | 62 | 0.7 | 520 | 0.7 | 2.7 | 2.4 | ○ | ○ |
| | 9 | 84 | $1.2 \times 10^2$ | 66 | 0.7 | 532 | 0.6 | 2.8 | 2.5 | ○ | ○ |
| | 10 | 80 | $4.0 \times 10^1$ | 76 | 0.6 | 530 | 0.3 | 3.7 | 2.6 | ○ | ○ |
| Comparative example | 11 | 80 | $2.4 \times 10^1$ | 32 | 0.8 | 519 | 0.2 | 12.5 | 4.2 | X | X |
| | 12 | 92 | $8.2 \times 10^2$ | 66 | 1.2 | 546 | 0.8 | 7.2 | 3.5 | X | X |
| | 13 | 90 | $8.8 \times 10^1$ | 68 | 0.7 | 538 | 0.8 | 6.2 | 3.2 | ○ | X |
| | 14 | 88 | $1.2 \times 10^1$ | 28 | 3.6 | 527 | 0.1 | 2.2 | 2.4 | X | X |

(Note)
[1]Pb/3% Pt mixed powder
[2]Cu/4% Ag mixed powder
[3]Pd/5% Au mixed powder
[4]Pt-10% Au alloy
[5]Upper layer thickness = Thickness from lower layer (metal powder containing layer) convex portion In the example of the invention, as is known from Table 4, the coating material in which the fine metal powder having an average primary particle diameter within a range of from 5 to 50 nm were dispersed in the solvent containing the dispersant, in a state of aggregation generating secondary particles having large variations of particle size distribution was used. As a result, in the lower conductive layer, for example as schematically shown in FIG. 2, considerable irregularities occurred on the interface (i.e., the surface of the lower layer) between the lower layer containing the fine metal powder and the upper layer not containing the same.

However, the forming method of the transparent conductive film of the invention is not limited to that presented in this example but the double-layered film may be formed by any method so far as it generates similar surface irregularities on the lower layer.

Although the fine metal powder formed relatively large secondary particles, the film had a satisfactory close adherence.

The transparent conductive film of this example showed, in all cases, a visible light minimum reflectance of up to 1%, a haze of up to 1%, and a whole visible light transmittance of at least 55% (at least 60% except for one), had a low reflectivity to permit prevention of ingression of external images, and a sufficient transparency not impairing visual recognition of images.

Comparison of values of reflectance at 400 nm and 800 nm shows that the values of reflectance are completely or substantially on the same level. As shown in FIG. 9B, the reflection spectrum increases on both sides of the minimum reflectance, exhibiting almost the same curve, with a relatively small degree of this increase. As a result, the film has a low reflectance, with substantially a colorless reflected light, and is excellent in luminous efficacy of images. Further, as shown in FIG. 9A, the transmission spectrum is very flat and the film itself is colorless.

In the comparative example, in contrast, while showing a low minimum reflectance, the increase in reflection spectrum is particularly large on the short wavelength side as shown in FIG. 10B: the reflectance at 400 nm is more than the twice as high as that at 800 nm. As a result, the reflected light is bluish, exerting an adverse effect on luminous efficacy of images.

In terms of conductivity, both transparent conductive films show a low resistance on the level of $10^2\Omega/\square$ since the lower layer contains the fine metal powder, enabling to sufficiently impart electromagnetic wave shielding property.

Example 5

Lower Layer Forming Coating Material

Aqueous dispersed solutions of various types of fine metal powder were prepared by the colloidal technique (reducing a metal compound through reaction with a reducing agent in the presence of a protecting colloid) and the primary particle size of the fine metal powder was measured on a TEM.

The aqueous dispersed solution of the fine metal powder was diluted with water and sufficiently stirred with the use of a propeller type stirrer, thereby obtaining a coating material, not containing a binder, having the composition shown in Table 5. The Fe content in this coating material was measured by ICP (high-frequency plasma emission analysis). The organic solvent used was a mixed solvent of a main solvent and a slight amount of glycol-based solvent. In some examples, however, one of the fluorine-based surfactant and the glycol-based solvent was omitted.

The symbols shown in Table 5 for the fluorine-based surfactant and the solvents have the following meanings:

Fluorine-Based Surfactant

F1: $[C_8F_{17}SO_2N(C_3H_7)CH_2CH_2O]_2PO_2H$

F2: $C_8F_{17}SO_2Li$

F3: $C_8F_{17}SO_2N(C_3H_7)CH_2CO_2K$

F4: $C_7F_{15}CO_2Na$

Glycol-Based Solvent

1) Polyhydric Alcohol

E.G.: Ethylene glycol

PG: Propyleneglycol

G: Glycerine

TMG: Trimethyleneglycol

2) Polyalkyleneglycol and Derivatives

DEG: Diethyleneglycol

DEGM: Diethyleneglycol monomethylether

DEGE: Diethyleneglycol monoethylether

DPGM: Dipropyleneglycol monomethylether

DPGE: Dipropyleneglycol monoethylether

EGME: Ethyleneglycol monomethylether

Main solvent

S1: Methanol 100%

S2: Mixed solvent of 75% methanol/25% ethanol

S3: Mixed solvent of 50% methanol/50% ethanol

Film Forming Method

A 100 mm×100 mm×2.8 mm thick glass substrate was preheated to 40° C. in an oven. Then, it was set on a spin coater, which was rotated at 150 rpm and the lower layer forming coating material prepared above was dropped in an amount of 2 cc. Then, after rotating the coater for 90 seconds, the substrate was heated again to 40° C. and the upper layer forming silica precursor solution was spin-coated under the same conditions. Subsequently, the substrate was heated in the oven to 200° C. for 20 minutes, thereby forming a double-layered film comprising a lower layer consisting of a fine metal powder film and an upper layer consisting of a silica-based film.

The silica precursor solution used for forming the upper layer was prepared by diluting a silica coating solution SC-100H made by Mitsubishi Material Corporation (silica sol having an $SiO_2$-converted concentration of 1.00% obtained from hydrolysis of ethylsilicate) so as to achieve an $SiO_2$-converted concentration of 0.70% with ethanol, and had a viscosity of 1.65 cps.

The cross section of the resultant transparent conductive film was observed on an SEM (scanning electron microscope): it was confirmed that the film was a double-layered film comprising a lower fine metal powder film and an upper silica film in all cases. The results of measurement of thickness of the upper and the lower layers from this SEM micrograph, and the results of measurement carried out as follows are comprehensively shown in Table 5.

Surface resistance: measured by the four-probe method (RORESTER AP: made by Mitsubishi Petrochemical).

Visible light transmittance: light transmittance was measured with a wavelength of 550 nm by means of a recording spectrophotometer (Model U-400, made by Hitachi Limited). Values measured with 550 nm are shown for the visible light transmittance. In the case of the fine metal powder of the invention, it has empirically been confirmed that the visible light transmittance of 550 nm almost agrees with the whole visible light transmittance.

Film formability: presence of film blurs such as color blurs, radial stripes and spots were inspected through visual observation of the exterior view of the transparent conductive film. A black vinyl tape (No. 21, made by Nitto Denko Co.) was pasted on the back of the glass substrate and this was visually observed from a distance of 30 cm: observation of no film blurs was marked ○ and presence of film blurs was marked x.

In the comprehensive evaluation, a case satisfying all the conditions including a surface resistance of up to $1\times10^2\Omega/\square$, a whole visual light transmittance of at least 60% and a film formability marked ○ was evaluated as ○, and a case not satisfying even a single condition was marked x.

Table 5 also shows the results of the comparative examples in which the primary particle size of fine metal powder or the composition of the lower layer forming coating material is outside the scope of the present invention.

As is clear from Table 5 use of the lower layer forming coating material of the invention improves film formability, and prevents the occurrence of film blurs which may affect the commercial requirements followed in the fine metal powder film. Because surface resistance is sufficiently low as up to $1\times10^8\Omega/\square$ to serve to shield electromagnetic waves and a whole visible light transmittance of at least 60% ensures transparency, the visual recognition of images required for a CRT or other display units is sufficiently ensured.

When the fine metal powder contains primary particles of over 20 nm, in contrast, film formability is poorer, and film blurs occur, with a considerably decreased conductivity of the film. A content of fine metal powder smaller than the specified level leads to a serious decrease in film conductivity, and a content of over the specified level result in poorer film formability and visible light transmittance.

In the additional comparative examples, the amount of the fluorine-based surfactant and/or the glycol-based solvent are outside the scope of the present invention. Film formability is poor and there is in some cases an adverse effect even on conductivity.

Figure 11:
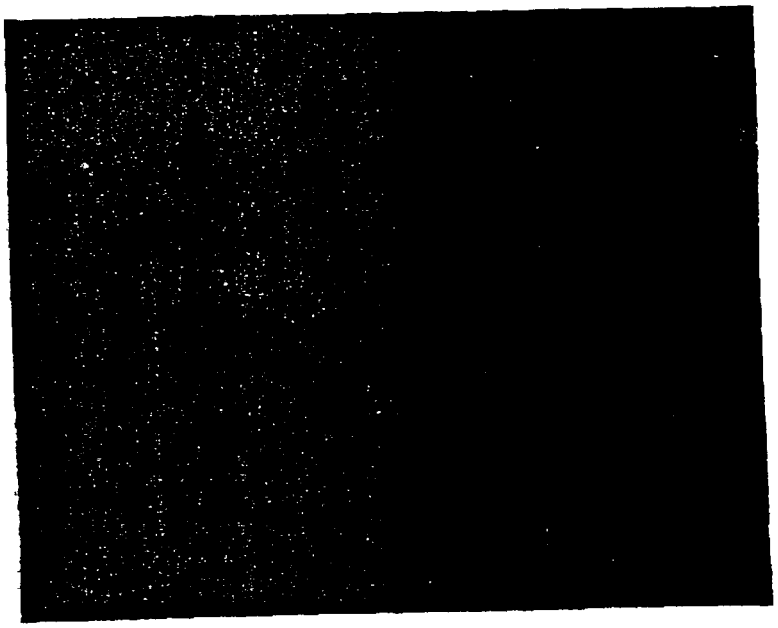
FIG. 11 is an optical microphotograph showing an exterior view of a transparent conductive film of the invention prepared in another embodiment.
Figure 12:
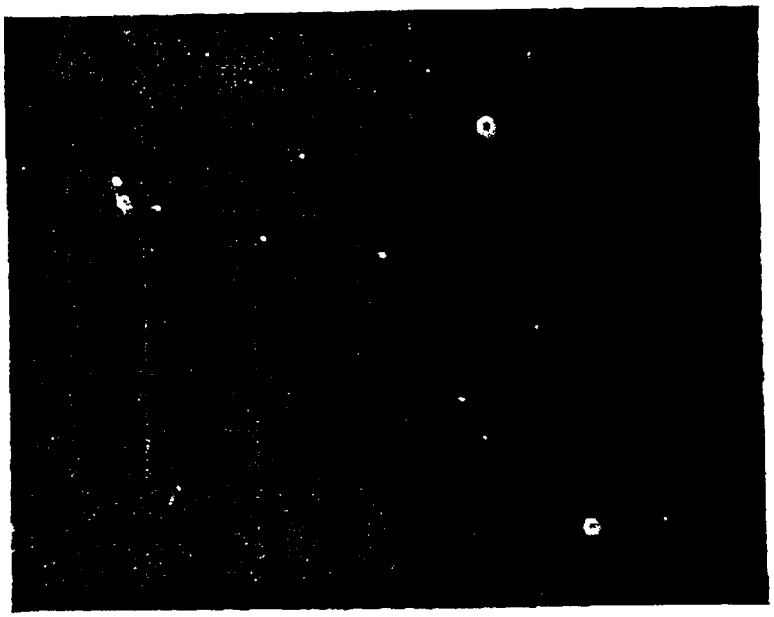
FIG. 12 is an optical microphotograph showing an exterior view of a transparent conductive film for comparison prepared in another embodiment.

FIG. 11 shows an optical microphotograph of a double-layered transparent conductive film exhibiting a satisfactory film formability (Test No. 9), and FIG. 12 shows an optical microphotograph of a double-layered transparent conductive film with a poor film formability (Test No. 23) (10 magnifications in both cases).

Figure 13:
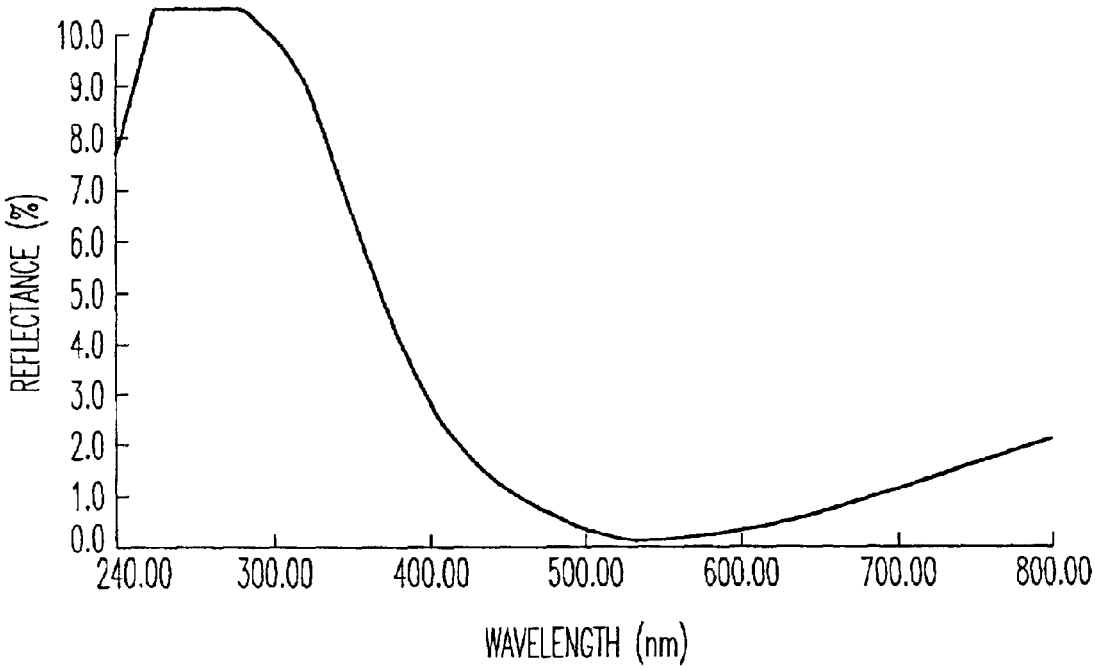
FIG. 13 is a reflection spectrum of a transparent conductive film of the invention prepared in the foregoing another embodiment.

FIG. 13 illustrates a reflection spectrum of the double-layered film of Test No. 14: a low minimum reflectance suggests a low reflectivity. Other double-layered transparent conductive films of the invention were provided with a low reflectivity on almost the same level.

TABLE 5-1

| | | Conductive film forming composition | | | | | | | | | | |
|---|---|---|---|---|---|---|---|---|---|---|---|---|
| | | Fine metal powder | | | | F-based activation agent | | | Glycol-based solvent | | Main solvent | |
| Division | Test No. | Kind[1] | Particle size[2] | wt % | Fe (wt %) | Kind | wt % | Water wt % | Kind | wt % | Kind | wt % |
| Example of invention | 1 | Au | 3–12 | 0.22 | 0 | F2 | 0.0070 | 3.48 | G | 0.50 | S2 | Balance |
| | 2 | Ag | 3–10 | 0.30 | 0.0023 | F1 | 0.0023 | 4.75 | DPGM | 0.50 | S1 | Balance |
| | | | | | | | | | DPGE | 0.50 | | |
| | 3 | Ag | 5–18 | 0.35 | 0.0146 | F3 | 0.0022 | 5.54 | TMG | 0.20 | S1 | Balance |
| | | | | | | | | | EG | 1.00 | | |
| | 4 | Ag | 5–18 | 0.50 | 0.0022 | F2 | 0.0750 | 7.91 | DEGM | 0.50 | S1 | Balance |
| | | | | | | | | | DEGE | 0.10 | | |
| | | | | | | | | | EG | 2.40 | | |
| | 5 | Pd | 3–8 | 0.40 | 0.0009 | F4 | 0.0025 | 6.30 | DEG | 0.50 | S1 | Balance |
| | | | | | | F2 | 0.0050 | | | | | |
| | 6 | Pt | 5–16 | 0.30 | 0.0011 | F1 | 0.0010 | 4.75 | EG | 0.75 | S2 | Balance |
| | | | | | | F2 | 0.0040 | | | | | |
| | 7 | Ru | 3–10 | 0.35 | 0.0030 | F2 | 0.0075 | 5.54 | DEG | 0.80 | S1 | Balance |
| | 8 | Ru | 3–10 | 0.30 | 0.0011 | F2 | 0.0065 | 10.00 | EG | 0.50 | S1 | Balance |
| | | | | | | | | | PG | 0.50 | | |
| | 9 | Ru | 3–10 | 0.32 | 0.0008 | F2 | 0.0045 | 5.07 | PG | 1.00 | S1 | Balance |
| | 10 | Rh | 3–12 | 0.34 | 0.0012 | F2 | 0.0060 | 5.38 | PG | 1.00 | S1 | Balance |
| | 11 | Au/Pd (72/28) | 6–16 | 0.31 | 0.0008 | — | — | 4.91 | EG | 1.50 | S1 | Balance |
| | 12 | Au/Ni (36/64) | 6–19 | 0.32 | 0.0140 | F3 | 0.0025 | 5.07 | — | — | S2 | Balance |
| | 13 | Au/Cu (24/76) | 7–18 | 0.34 | 0.0142 | F4 | 0.0025 | 5.38 | — | — | S2 | Balance |
| | 14 | Ag/Pd (91/09) | 3–11 | 0.28 | 0.0023 | F2 | 0.0047 | 4.43 | PG | 1.00 | S3 | Balance |

| | | Conductive film properties | | | | | |
|---|---|---|---|---|---|---|---|
| | Test | Thickness (nm) | | Visible light transmittance | Surface | Film-forming | |
| Division | No. | Upper | Lower | (%) | resistance (Ω/□) | property | Score |
| Example of Invention | 1 | 17 | 12 | 74.3 | $9.1 \times 10^2$ | ○ | ○ |
| | 2 | 19 | 90 | 73.5 | $5.2 \times 10^2$ | ○ | ○ |
| | 3 | 23 | 94 | 68.5 | $1.8 \times 10^2$ | ○ | ○ |
| | 4 | 39 | 106 | 61.5 | $7.9 \times 10^1$ | ○ | |
| | 5 | 41 | 98 | 62.1 | $1.1 \times 10^2$ | ○ | ○ |
| | 6 | 22 | 80 | 70.2 | $3.0 \times 10^2$ | ○ | ○ |
| | 7 | 26 | 96 | 63.8 | $5.0 \times 10^2$ | ○ | ○ |
| | 8 | 23 | 98 | 71.3 | $6.1 \times 10^2$ | ○ | ○ |
| | 9 | 25 | 95 | 70.6 | $4.9 \times 10^2$ | ○ | ○ |
| | 10 | 28 | 98 | 65.2 | $6.8 \times 10^2$ | ○ | ○ |
| | 11 | 33 | 53 | 64.4 | $4.0 \times 10^2$ | ○ | ○ |
| | 12 | 43 | 145 | 63.3 | $6.6 \times 10^2$ | ○ | ○ |
| | 13 | 48 | 127 | 62.8 | $6.8 \times 10^2$ | ○ | ○ |
| | 14 | 21 | 97 | 71.5 | $2.7 \times 10^2$ | ○ | ○ |

(note)
[1]For a binary mixture, the mixing ratio given in parentheses in the lower line represents a weight ratio.
[2]Primary particle size as measured by TEM.
[3]Fluorine surfactant

TABLE 5-2

| | | Conductive film forming composition | | | | | | | | | | |
|---|---|---|---|---|---|---|---|---|---|---|---|---|
| | | Fine metal powder | | | | F-based activation agent | | | Glycol-based solvent | | Main solvent | |
| Division | Test No. | Kind[1] | Particle size[2] | wt % | Fe (wt %) | Kind | wt % | Water wt % | Kind | wt % | Kind | wt % |
| Example of Invention | 15 | Ag/Pd (82/18) | 3–7 | 0.24 | 0.0021 | — | — | 3.80 | EG | 1.00 | S2 | Balance |
| | 16 | Ag/Pd (82/18) | 3–7 | 0.29 | 0.0022 | F2 | 0.0048 | 4.59 | — | — | S3 | Balance |

TABLE 5-2-continued

| | | | | | | | | | | | | |
|---|---|---|---|---|---|---|---|---|---|---|---|---|
| | 17 | Ag/Ru (83/17) | 3–10 | 0.28 | 0.0013 | F2 | 0.0110 | 14.5 | PG EG | 0.50 0.30 | S1 | Balance |
| | 18 | Ag/Ru (83/17) | 3–10 | 0.30 | 0.0008 | F2 | 0.0050 | 4.75 | PG | 1.00 | S3 | Balance |
| | 19 | Ag/Ru (74/26) | 3–12 | 0.31 | 0.0007 | F2 | 0.0050 | 4.91 | EG | 1.50 | S3 | Balance |
| | 20 | Ag/Rh (84/16) | 3–14 | 0.35 | 0.0008 | F2 | 0.0050 | 5.54 | EG | 1.00 | S3 | Balance |
| Comp. exp. | 21 | Au | 8–28 | 0.30 | 0.0025 | F2 | 0.0130 | 4.75 | G | 0.50 | S2 | Balance |
| | 22 | Ag | 3–6 | 0.18 | 0.0030 | F2 | 0.0030 | 5.00 | PG | 1.00 | S3 | Balance |
| | 23 | Ag | 3–16 | 0.53 | 0.0025 | F2 | 0.0130 | 10.00 | PG | 1.00 | S3 | Balance |
| | 24 | Pt | 3–12 | 0.30 | 0.0012 | — | 0 | 4.75 | — | 0 | S3 | Balance |
| | 25 | Ru | 3–10 | 0.30 | 0.0028 | F3 | 0.0015 | 4.75 | DPGM | 0.08 | S2 | Balance |
| | 26 | Rh | 3–12 | 0.30 | 0.0026 | F4 | 0.0015 | 4.75 | DEGE | 0.08 | S2 | Balance |
| | 27 | Ag/Pd (91/09) | 3–10 | 0.30 | 0.0025 | F1 | 0.0850 | 4.75 | EG | 1.50 | S1 | Balance |
| | 28 | Ag/Pd (91/09) | 3–10 | 0.30 | 0.0025 | F3 | 0.0050 | 4.75 | DEG | 3.15 | S3 | Balance |
| | 29 | Ag/Ru (83/17) | 3–10 | 0.30 | 0.0028 | F4 | 0.0050 | 4.75 | PG | 3.10 | S3 | Balance |

| | | Conductive film properties | | | | | |
|---|---|---|---|---|---|---|---|
| | Test | Thickness (nm) | | Visible light transmittance | Surface | Film-forming | |
| Division | No. | Upper | Lower | (%) | resistance (Ω/□) | property | Score |
| Example of Invention | 15 | 9 | 87 | 76.3 | $6.8 \times 10^3$ | ○ | ○ |
| | 16 | 18 | 95 | 71.8 | $3.1 \times 10^2$ | ○ | ○ |
| | 17 | 24 | 88 | 68.5 | $4.0 \times 10^2$ | ○ | ○ |
| | 18 | 19 | 95 | 72.1 | $4.5 \times 10^7$ | ○ | ○ |
| | 19 | 22 | 90 | 70.0 | $4.8 \times 10^2$ | ○ | ○ |
| | 20 | 20 | 97 | 71.1 | $6.8 \times 10^2$ | ○ | ○ |
| Comp. exp. | 21 | 26 | 88 | 63.3 | $4.1 \times 10^4$ | X | X |
| | 22 | 7 | 93 | 82.8 | $1.8 \times 10^4$ | ○ | X |
| | 23 | 54 | 102 | 41.1 | $1.8 \times 10^4$ | X | X |
| | 24 | 17 | 87 | 71.1 | $2.8 \times 10^4$ | X | X |
| | 25 | 23 | 95 | 65.1 | $2.1 \times 10^3$ | X | X |
| | 26 | 22 | 156 | 66.8 | $9.1 \times 10^2$ | X | X |
| | 27 | 18 | 97 | 68.1 | $8.8 \times 10^2$ | X | X |
| | 28 | 36 | 90 | 61.1 | $1.8 \times 10^2$ | X | X |
| | 29 | 26 | 7 | 63.0 | $3.8 \times 10^3$ | X | X |

(note)
[1]For a binary mixture, the mixing ratio given in parentheses in the lower line represents a weight ratio.
[2]Primary particle size as measured by TEM.
[3]Fluorine surfactant
Underscored figures are outside the scope of the invention.

Example 6

A glass substrate having the double-layered transparent conductive film formed in Example 5 was preheated to 60° C. and a 0.5% ethylsilicate solution in a mixed solvent of ethanol/isopropanol/butanol/0.05N nitric acid at a weight ratio of 5/2/1/1 was sprayed onto the surface of the film. The sprayed substrate was baked at 160° C. for ten minutes.

Figure 14:
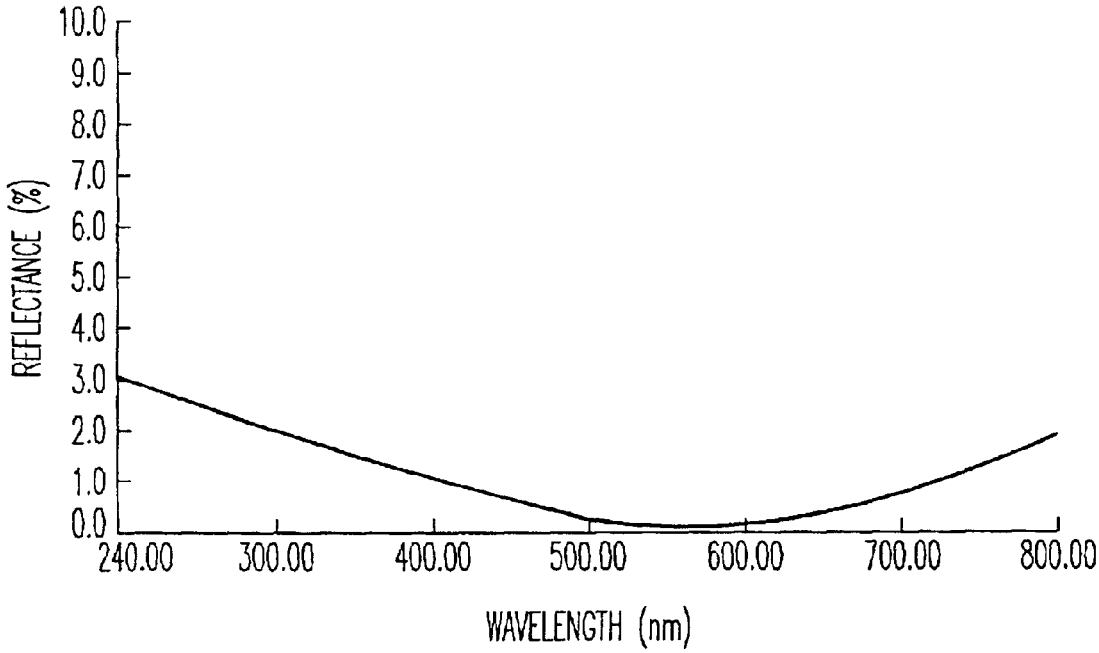
FIG. 14 is a reflection spectrum of a film having silica-based fine concave-convex layer formed further on the transparent conductive film shown in FIG. 13.

The reflection spectrum after spraying onto the double-layered film of Test No. 14 is represented in FIG. 14. From comparison of FIGS. 13 and 14, it is suggested that forming a layer having fine irregularities on the double-layered film by spraying leads to a considerable decrease in reflectance in the visible light short wavelength region (up to 400 nm), resulting in a more flat reflection spectrum.

Example 7

The fine metal powder films of Tests Nos. 3, 7, 14 and 17 were formed into single-layer films on the glass substrates in the same manner as in Example 5 and heat-treated by heating to 300° C. for ten minutes in the open air. Measured results of surface resistance for these fine metal powder films before and after heat treatment were as follows. These results suggest that the heat treatment brought about a lower resistance, resulting in an improved conductivity.

TABLE 6

| | | Surface resistance (Ω/□) | |
|---|---|---|---|
| Test No. | Kind of metal | Before heat treatment | After heat treatment |
| 3 | Ag | $8.9 \times 10^6$ | $5.2 \times 10^1$ |
| 7 | Ru | $1.2 \times 10^7$ | $6.1 \times 10^1$ |
| 14 | Ag/Pd(91/9) | $9.5 \times 10^5$ | $2.7 \times 10^1$ |
| 17 | Ag/Ru(83/17) | $8.1 \times 10^6$ | $3.8 \times 10^1$ |

Example 8

Lower Layer Forming Coating Material

Aqueous dispersed solution of various types of fine metal powder were prepared by the colloidal technique (reducing a metal compound through reaction with a reducing agent in the presence of a protecting colloid) and desalted by the application of centrifugal separation/repulping method so that the dispersing medium has an electric conductivity of up to 7.0 mS/cm. Primary particle size of fine metal powder in this dispersed solution was measured on a TEM.

A coating roginal solution having a composition as shown in Table 7 and not containing a binder was prepared by adding a protecting agent and/or an organic solvent and/or pure water to the aqueous dispersed solution of the fine metal powder and sufficiently stirring the solution. Measured results of pH and electric conductivity of the resultant dispersing medium of coating material are shown also in FIG. 7.

The symbols for the protecting agent and the organic solvent shown in Table 7 have the following meanings:

Protecting Agent

1) Masking Agent
   CA: Citric acid
2) Anionic Surfactant
   SD: Sodium dodecylbenzenesulfonate
   ON: Sodium oleate
3) Nonionic Surfactant
   PN: Polyethyleneglycol-mono p-nonylphenylether
   PL: Polyethyleneglycol-monolaurate
4) Fluorine-Based Surfactant
   F1: $[C_8F_{17}SO_2N(C_2H_7)CH_2CH_2O]_2PO_2H$
   F2: $C_8F_{17}SO_3Li$
   F3: $C_8F_{17}SO_2N(C_2H_7)CH_2CO_2K$
   F4: $C_7F_{15}CO_2Na$ Organic Solvent 1) Monohydric Alcohol (in an amount of up to 40%)
   MeOH: Methanol
   EtOH: Ethanol
2) Polyhydric Alcohol or Polyalkyleneglycol and Derivatives Thereof (in an amount up to 30%)
   E.G.: Ethyleneglycol
   PG: Propyleneglycol
   G: Glycerine
   TMG: Trimethyleneglycol
   DEG: Diethyleneglycol
   DEGM: Diethyleneglycol monomethylether
   EDGE: Diethyleneglycol monoethylether
   DPGM: Dipropyleneglycol monomethylether
   DPGE: Dipropyleneglycol monoethylether
   EGME: Ethyleneglycol monomethylether
3) Other Solvents (in an amount up to 15%)
   TG: Thioglycol
   TGR: α-thioglycerol
   DMS: Dimethylsulfoxide.

Film Forming Method

A coating solution was prepared by diluting the foregoing coating original solution with an organic solvent for dilution so as to achieve a concentration of the fine metal powder of 0.30% and sufficiently stirring the same in a propeller stirrer. The organic solvent used for dilution was a mixed solvent comprising methanol and ethanol mixed at a weight ratio of 50/50 and contained propyleneglycol (glycol-based solvent) in an amount of 0.5 weight parts relative to 100 weight parts of this solvent and a fluorine-based surfactant represented by F2 above in 0.005 weight parts.

Dilution with the organic solvent (preparation of the coating solution) was carried out on (1) the day when the coating original solution was prepared (first day), (2) the thirtieth day, and (3) forty-fifth day. Storage of the coating original solution was accomplished by tightly plugging a flask and quietly placing the same at room temperature (15 to 20° C.).

The coating solution prepared by dilution and containing the fine metal powder was used for coating immediately after stirring. Film formation was conducted in the same manner as in Example 5, thereby forming a double-layered film comprising a lower fine metal powder film and an upper silica-based film on the glass substrate.

The cross-section of the resultant transparent conductive film was observed on an SEM (scanning electron microscope): the film was a double-layered film comprising a lower fine metal powder film and an upper silica film in all cases. Properties of this double-layered film were evaluated as in Example 5. The results are shown also in Table 7.

Regarding storage stability of the coating original solution before dilution, a case satisfying all the conditions including a surface resistance of up to $1\times10^3\Omega/\square$, a whole visible light transmittance of at least 60%, and a film formability marked ○ was evaluated as ○ (stable and applicable) and a case not satisfying even a single one of these conditions was evaluated as x (not stable, not applicable).

TABLE 7-1

| | | Conductive film forming composition (balance is water) | | | | | | | | | | Film properties | | | |
|---|---|---|---|---|---|---|---|---|---|---|---|---|---|---|---|
| | | Fine metal particles | | | Protectant | | Organic conductivity | | | Electric conductivity | Liquid storage | Visible light transmittance (%) | Surface resistance (Ω/□) | Film forming property | Storage stability |
| Division | Test No. | Kind[1] | Particle size[2] | wt % | Kind | wt % | Kind | wt % | pH | (mS/cm) | in days | | | | |
| Example of invention | 1 | Au | 3–12 | 2.02 | SD | 0.098 | G | 5.0 | 4.1 | 4.1 | 1 | 62.5 | $2.1\times10^2$ | ○ | ○ |
| | | | | | F4 | 0.020 | | | | | 30 | 63.3 | $3.8\times10^2$ | ○ | ○ |
| | | | | | | | | | | | 45 | 54.0 | $1.1\times10^2$ | ○ | X |
| | 2 | Ag | 3–10 | 9.83 | CA | 0.854 | EGME | 13.5 | 7.8 | 6.9 | 1 | 75.5 | $4.6\times10^2$ | ○ | ○ |
| | | | | | | | DMS | 2.0 | | | 30 | 68.8 | $4.8\times10^2$ | ○ | ○ |
| | | | | | | | | | | | 45 | 67.2 | $6.8\times10^2$ | ○ | ○ |
| | 3 | Ag | 5–18 | 3.06 | CA | 0.285 | MeOH | 38.0 | 4.2 | 4.9 | 1 | 72.0 | $4.2\times10^2$ | ○ | ○ |
| | | | | | | | DPGE | 3.0 | | | 30 | 75.0 | $5.0\times10^2$ | ○ | ○ |
| | | | | | | | | | | | 45 | 71.1 | $6.8\times10^2$ | ○ | ○ |
| | 4 | Ag | 5–18 | 3.06 | — | — | — | — | 5.1 | 2.7 | 1 | 76.6 | $5.6\times10^3$ | ○ | ○ |
| | | | | | | | | | | | 30 | 72.1 | $4.1\times10^3$ | ○ | ○ |
| | | | | | | | | | | | 45 | 70.8 | $5.6\times10^2$ | ○ | ○ |
| | 5 | Pd | 3–8 | 2.02 | CA | 0.255 | DEGM | 7.0 | 6.1 | 1.2 | 1 | 71.1 | $2.1\times10^3$ | ○ | ○ |
| | | | | | | | DPGM | 3.0 | | | 30 | 70.8 | $6.5\times10^2$ | ○ | ○ |
| | | | | | | | | | | | 45 | 55.7 | $7.4\times10^2$ | ○ | X |
| | 6 | Pt | 5–16 | 2.03 | PN | 0.095 | DEG | 4.0 | 6.5 | 1.6 | 1 | 65.5 | $8.6\times10^3$ | ○ | ○ |
| | | | | | F2 | 0.032 | TGR | 1.0 | | | 30 | 63.6 | $7.2\times10^2$ | ○ | ○ |
| | | | | | | | | | | | 45 | 55.5 | $5.3\times10^2$ | ○ | X |
| | 7 | Ru | 3–10 | 5.01 | PL | 0.210 | EG | 15.0 | 6.3 | 2.2 | 1 | 76.3 | $7.9\times10^3$ | ○ | ○ |
| | | | | | | | | | | | 30 | 70.8 | $8.1\times10^2$ | ○ | ○ |
| | | | | | | | | | | | 45 | 71.1 | $6.9\times10^3$ | ○ | ○ |

TABLE 7-1-continued

| | | Conductive film forming composition (balance is water) | | | | | | | | | | Film properties | | | |
|---|---|---|---|---|---|---|---|---|---|---|---|---|---|---|---|
| | | Fine metal particles | | | Protectant | | Organic conductivity | | | Electric conductivity | Liquid storage | Visible light transmittance (%) | Surface resistance (Ω/□) | Film forming property | Storage stability |
| Division | Test No. | Kind[1] | Particle size[2] | wt % | Kind | wt % | Kind | wt % | pH | (mS/cm) | in days | | | | |
| | 8 | Ru | 3–10 | 2.97 | ON | 0.153 | MeOH | 20.0 | 6.6 | 0.8 | 1 | 67.5 | $6.2 \times 10^2$ | ○ | ○ |
| | | | | | | | EtOH | 10.0 | | | 30 | 63.0 | $5.2 \times 10^2$ | ○ | ○ |
| | | | | | | | DEGE | 3.0 | | | 45 | 61.0 | $1.2 \times 10^2$ | ○ | X |
| | 9 | Ru | 3–10 | 5.95 | SD | 0.101 | — | — | 5.1 | 1.9 | 1 | 73.3 | $4.6 \times 10^2$ | ○ | ○ |
| | | | | | | | | | | | 30 | 73.6 | $5.3 \times 10^2$ | ○ | ○ |
| | | | | | | | | | | | 45 | 63.0 | $8.9 \times 10^2$ | ○ | ○ |
| | 10 | Rh | 3–12 | 4.03 | SD | 0.074 | EG | 12.0 | 5.8 | 1.8 | 1 | 72.3 | $7.8 \times 10^2$ | ○ | ○ |
| | | | | | | | | | | | 30 | 64.5 | $6.8 \times 10^2$ | ○ | ○ |
| | | | | | | | | | | | 45 | 66.9 | $6.1 \times 10^2$ | ○ | ○ |
| | 11 | Au/Pd 72/28 | 6–16 | 9.78 | SD | 0.972 | G | 40.0 | 4.3 | 0.8 | 1 | 68.1 | $3.2 \times 10^2$ | ○ | ○ |
| | | | | | | | | | | | 30 | 61.0 | $4.2 \times 10^2$ | ○ | ○ |
| | | | | | | | | | | | 45 | 72.1 | $2.1 \times 10^3$ | X | X |
| | 12 | Au/Ni 36/64 | 6–19 | 3.02 | ON | 0.256 | TG | 6.0 | 7.4 | 0.7 | 1 | 63.3 | $8.7 \times 10^2$ | ○ | ○ |
| | | | | | F4 | 0.050 | | | | | 30 | 61.1 | $8.9 \times 10^2$ | ○ | ○ |
| | | | | | | | | | | | 45 | 62.2 | $2.3 \times 10^2$ | X | X |
| | 13 | Au/cu 24/76 | 7–18 | 3.00 | ON | 0.295 | TMG | 6.0 | 6.3 | 0.8 | 1 | 61.8 | $8.8 \times 10^2$ | ○ | ○ |
| | | | | | | | | | | | 30 | 62.3 | $7.8 \times 10^2$ | ○ | ○ |
| | | | | | | | | | | | 45 | 72.3 | $3.5 \times 10^5$ | X | X |
| | 14 | Ag/Pd 91/09 | 3–11 | 6.02 | CA | 0.685 | EG | 18.0 | 6.2 | 4.2 | 1 | 80.2 | $3.6 \times 10^2$ | ○ | ○ |
| | | | | | F2 | 0.050 | | | | | 30 | 76.5 | $6.8 \times 10^2$ | ○ | ○ |
| | | | | | | | | | | | 45 | 73.2 | $4.3 \times 10^2$ | ○ | ○ |
| | 15 | Ag/Pd 82/18 | 3–13 | 3.03 | CA | 0.088 | — | — | 5.8 | 1.4 | 1 | 76.8 | $1.3 \times 10^2$ | ○ | ○ |
| | | | | | | | | | | | 30 | 68.2 | $3.2 \times 10^2$ | ○ | ○ |
| | | | | | | | | | | | 45 | 70.6 | $2.7 \times 10^2$ | ○ | ○ |

[1]The mixing ratio of mixture is a weight ratio.
[2]TEM primary particle size.

TABLE 7-2

| | | Conductive film forming composition (balance is water) | | | | | | | | | | Film properties | | | |
|---|---|---|---|---|---|---|---|---|---|---|---|---|---|---|---|
| | | Fine metal particles | | | Protectant | | Organic conductivity | | | Electric conductivity | Liquid storage | Visible light transmittance (%) | Surface resistance (Ω/□) | Film forming property | Storage stability |
| Division | Test No. | Kind[1] | Particle size[2] | wt % | Kind | wt % | Kind | wt % | pH | (mS/cm) | in days | | | | |
| Example of invention | 16 | Ag/Pd 82/18 | 3–13 | 5.92 | — | — | PG | 18.0 | 6.2 | 1.3 | 1 | 78.8 | $2.0 \times 10^2$ | ○ | ○ |
| | | | | | | | | | | | 30 | 73.2 | $3.9 \times 10^2$ | ○ | ○ |
| | | | | | | | | | | | 45 | 72.2 | $6.1 \times 10^2$ | ○ | ○ |
| | 17 | Ag/Ru 83/17 | 3–10 | 6.02 | PL | 0.122 | PG | 18.0 | 5.9 | 3.5 | 1 | 76.2 | $6.2 \times 10^2$ | ○ | ○ |
| | | | | | | | | | | | 30 | 70.6 | $8.2 \times 10^2$ | ○ | ○ |
| | | | | | | | | | | | 45 | 71.5 | $5.4 \times 10^2$ | ○ | ○ |
| | 18 | Ag/Ru 83/17 | 3–10 | 6.02 | ON | 0.156 | — | — | 6.1 | 3.2 | 1 | 73.2 | $7.5 \times 10^2$ | ○ | ○ |
| | | | | | | | | | | | 30 | 68.2 | $6.8 \times 10^3$ | ○ | ○ |
| | | | | | | | | | | | 45 | 63.2 | $8.9 \times 10^2$ | ○ | ○ |
| | 19 | Ag/Ru 74/26 | 3–12 | 3.01 | SD | 0.064 | EG | 10.0 | 6.7 | 1.6 | 1 | 75.1 | $8.1 \times 10^2$ | ○ | ○ |
| | | | | | | | | | | | 30 | 71.1 | $5.7 \times 10^2$ | ○ | ○ |
| | | | | | | | | | | | 45 | 68.8 | $7.5 \times 10^2$ | ○ | ○ |
| | 20 | Ag/Rh 84/16 | 3–14 | 6.03 | SD | 0.185 | EG | 10.0 | 5.8 | 1.0 | 1 | 72.1 | $8.8 \times 10^2$ | ○ | ○ |
| | | | | | | | | | | | 30 | 70.8 | $4.8 \times 10^2$ | ○ | ○ |
| | | | | | | | | | | | 45 | 72.2 | $6.5 \times 10^2$ | ○ | ○ |
| Comparative example | 21 | Au | 8–28 | 3.05 | CA | 0.015 | G | 5.0 | 6.2 | 3.8 | 1 | 62.2 | $6.8 \times 10^2$ | ○ | ○ |
| | | | | | | | | | | | 30 | 53.5 | $1.4 \times 10^5$ | X | X |
| | 22 | Ag | 3–10 | 12.00 | CA | 0.920 | MeOH | 25.0 | 6.5 | 6.1 | 1 | 78.3 | $2.4 \times 10^2$ | ○ | ○ |
| | | | | | | | | | | | 30 | 61.2 | $3.2 \times 10^5$ | X | X |
| | 23 | Ag | 3–16 | 3.10 | CA | 0.310 | — | — | 5.2 | 7.6 | 1 | 76.8 | $3.1 \times 10^2$ | ○ | ○ |
| | | | | | | | | | | | 30 | 58.8 | $6.8 \times 10^6$ | X | X |
| | 24 | Pt | 3–12 | 2.01 | PN | 0.098 | MeOH | 10.0 | 6.5 | 6.2 | 1 | 63.3 | $8.9 \times 10^2$ | ○ | ○ |
| | | | | | F2 | 0.040 | EtOH | 45.0 | | | 30 | 49.2 | $1.2 \times 10^7$ | X | X |
| | 25 | Rh | 3–12 | 1.70 | SD | 0.050 | EG | 5.0 | 6 | 1.1 | 1 | 67.2 | $7.2 \times 10^2$ | X | X |
| | 26 | Ag/Pd 91/09 | 3–10 | 6.05 | CA | 0.710 | EG | 33.0 | 5.9 | 6.1 | 1 | 63.8 | $8.8 \times 10^2$ | X | X |
| | 27 | Ag/Pd 91/09 | 3–10 | 6.05 | CA | 0.710 | DMS | 16.5 | 6.2 | 6.4 | 1 | 63.2 | $7.8 \times 10^2$ | X | X |

TABLE 7-2-continued

| | | Conductive film forming composition (balance is water) | | | | | | | | | | Film properties | | | |
|---|---|---|---|---|---|---|---|---|---|---|---|---|---|---|---|
| | | Fine metal particles | | | | | Organic | | | Electric conductivity | Liquid storage | Visible light transmittance (%) | Surface resistance (Ω/□) | Film forming property | Storage stability |
| | Test | | Particle | | Protectant | | conductivity | | | | | | | | |
| Division | No. | Kind[1] | size[2] | wt % | Kind | wt % | Kind | wt % | pH | (mS/cm) | in days | | | | |
| | 28 | Ag/Pd | 3–10 | 6.05 | CA | 0.710 | TG | 13.0 | 6.6 | 6.4 | 1 | 68.8 | $6.8 \times 10^2$ | ○ | ○ |
| | | 91/09 | | | | | TGR | 3.0 | | | 30 | 58.1 | $5.2 \times 10^5$ | X | X |
| | 29 | Ag/Ru | 3–10 | 6.01 | ON | 0.181 | — | — | 9.3 | 6.6 | 1 | 76.8 | $3.5 \times 10^2$ | ○ | ○ |
| | | 83/17 | | | | | | | | | 30 | 69.6 | $8.2 \times 10^2$ | X | X |

[1]The mixing ratio of mixture is a weight ratio.
[2]TEM primary particle size.
Underscored figures are outside the scope of the invention.

As is shown in Table 7, the coating original solution of the invention is excellent in storage stability even when containing the fine metal powder at a high concentration before dilution. After storage of at least 30 days, film formability is maintained on a satisfactory level. Coating with this solution after dilution, a transparent conductive film having a surface resistance value of up to $1\times10^2\Omega/\square$ which is sufficient to shield electromagnetic waves and a high transparency as typically represented by a high whole visible light transmittance of at least 60% could be formed without causing film blurs affecting the commercial value.

When any of the primary particle size of the fine metal powder, the coating material composition before dilution, electric conductivity and pH of the dispersing medium of this coating material is outside the scope of the invention, in contrast, film formability is insufficient even at the beginning, leading to occurrence of film blurs or to a lower storage stability, causing film blurs after the lapse of 30 days of storage.

Figure 15:
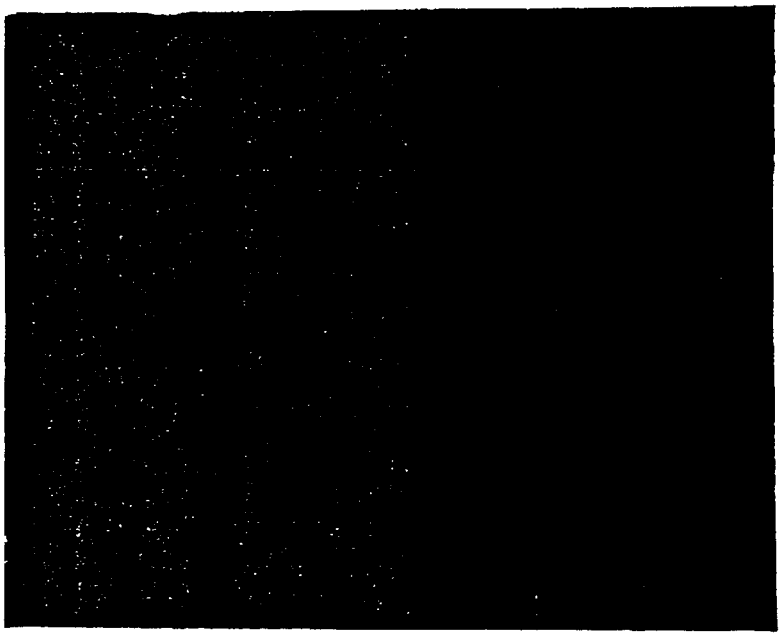
FIG. 15 is an optical microphotograph showing an exterior view of the invention prepared in another embodiment.
Figure 16:
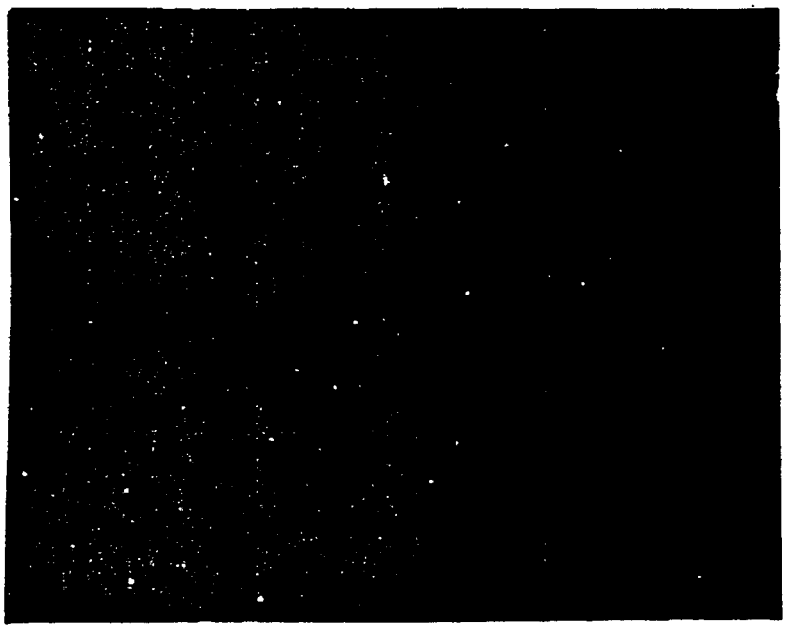
FIG. 16 is an optical microphotograph showing an exterior view of a transparent conductive film for comparison prepared in another embodiment.

FIG. 15 shows an optical micrograph of the exterior view of the double-layered transparent conductive film formed as described above using the coating original solution of Test No. 14 stored for 45 days during which a good film formability was maintained. FIG. 16 shows a similar optical microphotograph of a case where the coating original solution of Test No. 22 in which the solution was stored for 30 days during which film formability was poor (10 magnifications in all cases).

Figure 17:
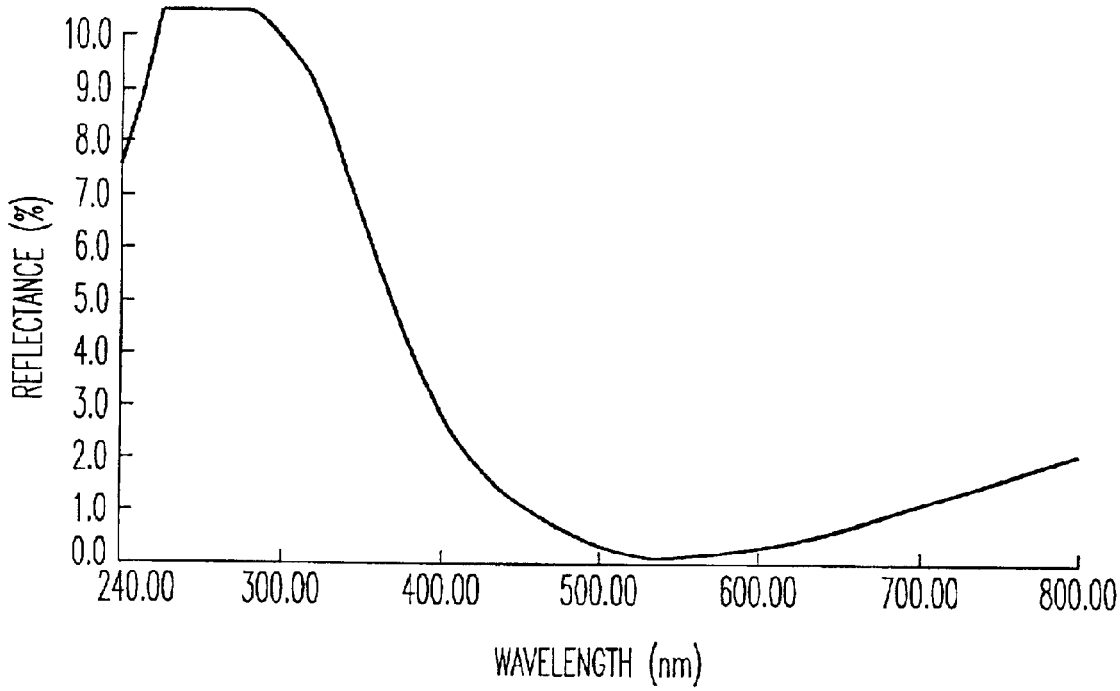
FIG. 17 is a reflection spectrum of a transparent conductive film of the invention prepared in the foregoing another embodiment.

FIG. 17 illustrates a reflection spectrum of a double-layered transparent conductive film formed as described above using the coating original solution of Test No. 14 stored for 45 days. This suggests that the film has a low reflectance, resulting in a low reflectivity. The other double-layered films were also provided with a low reflectivity on the same level.

Example 9

A glass substrate having a double-layered transparent conductive film formed in Example 8 was preheated to 60° C. and a 0.5% ethylsilicate solution in a mixed solvent of ethanol/isopropanol/butanol/0.5N nitric acid mixed at a weight ratio of 5/2/1/1 was sprayed onto the surface of the film for two seconds. The sprayed film was then baked at 160° C. for ten minutes.

Figure 18:
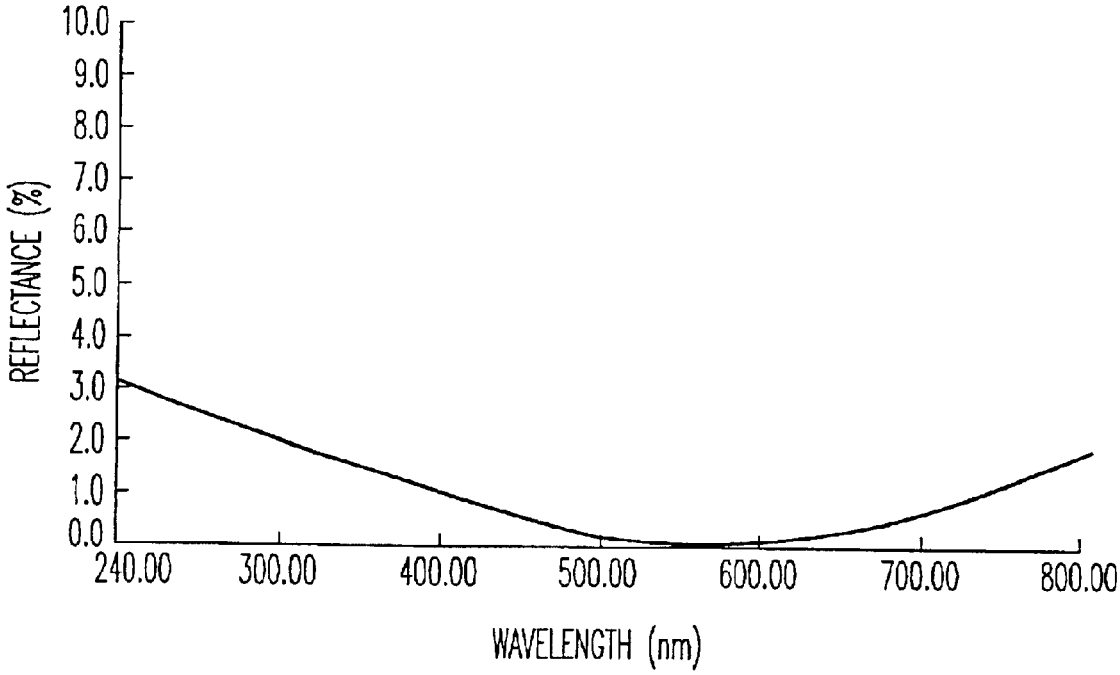
FIG. 18 is a reflection spectrum of a film further having a silica-based fine concave-convex layer formed on the transparent conductive film shown in FIG. 17.

The reflection spectrum, after spraying onto the double-layered film of Test No. 14, is illustrated in FIG. 18. Comparison of FIGS. 17 and 18 reveal that formation of fine irregularities on the double-layered film by spraying causes a considerable decrease in reflectance in the visible light short wavelength region (up to 400 nm) and the reflection spectrum becomes flat.

Example 10

One of the other organic solvents in an amount of up to 2%, as shown in Table 8, was added in an amount of 2% (invention) or 4% (comparative example) to the coating original solution of Test No. 4 in Example 8. The mixture was sufficiently stirred, stored at the room temperature (15 to 20° C.), and presence of aggregation was visually observed to record the day on which aggregation was observed. Table 8 shows the kinds of organic solvents, days of storage before aggregation, and the state of aggregation.

TABLE 8-1

| | | | Days before aggregation and state of aggregation | | | |
|---|---|---|---|---|---|---|
| Test | Other organic solvent added | | Amount of addition: | | | |
| No. | Kind | Name | 2.0 wt % | | Amount of addition: 4.0 wt % | |
| 1 | 1) | 1-propanol | 49 days | Discolored | 21 days | Discolored |
| 2 | | 2-propanol | 49 days | Discolored | 21 days | Discolored |
| 3 | | 1-butanol | 49 days | Discolored | 21 days | Discolored |
| 4 | | 2-butanol | 49 days | Discolored | 21 days | Discolored |
| 5 | | Isobutanol | 49 days | Discolored | 21 days | Precipitated |
| 6 | | Tert-butyl alcohol | 42 days | Discolored | 21 days | Precipitated |
| 7 | | 1-decanol | 42 days | Discolored | 21 days | Precipitated |
| 8 | | Trifluoroethanol | 42 days | Discolored | 21 days | Completely separated |
| 9 | | Benzyl alcohol | 42 days | Discolored | 21 days | Completely separated |
| 10 | | α-terpineol | 42 days | Discolored | 21 days | Completely separated |
| 11 | 2) | 2-ethoxyethanol | 49 days | Discolored | 21 days | Discolored |

TABLE 8-1-continued

| Test | Other organic solvent added | | Days before aggregation and state of aggregation | | | |
|---|---|---|---|---|---|---|
| | | | Amount of addition: | | | |
| No. | Kind | Name | 2.0 wt % | | Amount of addition: 4.0 wt % | |
| 12 | | 2-isopropoxyethanol | 49 days | Discolored | 21 days | Discolored |
| 13 | | 2-n-butoxyethanol | 49 days | Discolored | 21 days | Discolored |
| 14 | | 1-iso-butoxyethanol | 49 days | Discolored | 21 days | Discolored |
| 15 | | 2-tert-butoxyethanol | 49 days | Discolored | 21 days | Discolored |
| 16 | | 1-methoxy-2-propanol | 35 days | Discolored | 21 days | Discolored |
| 17 | | 1-ethoxy-2-propanol | 35 days | Discolored | 21 days | Discolored |
| 18 | | 2-(isopentyloxy) propanol | 35 days | Precipitated | 21 days | Discolored |
| 19 | | 2-(2-butoxyethoxy) ethanol | 35 days | Discolored | 14 days | Completely separated |
| 20 | | Furfuryl alcohol | 35 days | Discolored | 14 days | Completely separated |
| 21 | | Tetrahydrofurfuryl alcohol | 35 days | Precipitated | 14 days | Completely separated |
| 22 | | Tetrahydrofuran | 35 days | Precipitated | 14 days | Completely separated |
| 23 | 3) | 2-aminoekunol | 63 days | Discolored | 28 days | Discolored |
| 24 | | 2-dimethylaminoethanol | 63 days | Discolored | 28 days | Discolored |
| 25 | | 2-dimethylaminoethanol | 63 days | Discolored | 28 days | Discolored |
| 26 | | Diethanolamine | 63 days | Discolored | 28 days | Discolored |
| 27 | | Diethylamine | 56 days | Discolored | 28 days | Discolored |
| 28 | | Triethylamine | 56 days | Discolored | 28 days | Discolored |
| 29 | | Propylamine | 56 days | Discolored | 21 days | Precipitated |
| 30 | | Isopropylamine | 49 days | Discolored | 21 days | Precipitated |
| 31 | | Dipropylamine | 49 days | Discolored | 21 days | Precipitated |
| 32 | | Diisopropylamine | 49 days | Discolored | 21 days | Discolored |
| 33 | | Butylamine | 56 days | Discolored | 21 days | Discolored |
| 34 | | Isobutylamine | 56 days | Discolored | 21 days | Discolored |
| 35 | | Sec-butylamine | 56 days | Discolored | 14 days | Discolored |
| 36 | | Dibutylamine | 56 days | Discolored | 14 days | Discolored |
| 37 | | Diisobutylamine | 56 days | Discolored | 14 days | Discolored |
| 38 | | Tributylamine | 56 days | Discolored | 14 days | Discolored |
| 39 | | Formamide | 63 days | Discolored | 28 days | Discolored |
| 40 | | N-methylformamide | 63 days | Discolored | 28 days | Discolored |
| 41 | | N,N-dimethylformamide | 63 days | Discolored | 28 days | Discolored |
| 42 | | Acetamide | 63 days | Discolored | 28 days | Discolored |
| 43 | | N,N-dimethylacetamide | 49 days | Discolored | 21 days | Discolored |
| 44 | | N-methyl-2-pyrrolidine | 49 days | Discolored | 21 days | Discolored |

(Note)
1) Monohydric alcohol
2) Ether or ether alcohol
3) Nitrogen days containing organic compound

TABLE 8-2

| Test | Other organic solvent added | | Days before aggregation and state of aggregation | | | |
|---|---|---|---|---|---|---|
| | | | Amount of addition: | | Amount of addition: | |
| No. | Kind | Name | 2.0 wt % | | 4.0 wt % | |
| 45 | 4) | Benzene | 49 days | Precipitated | 21 days | Precipitated |
| 46 | | Toluene | 49 days | Precipitated | 21 days | Precipitated |
| 47 | | Xylene | 49 days | Precipitated | 21 days | Precipitated |
| 48 | | Cyclohexane | 56 days | Precipitated | 28 days | Precipitated |
| 49 | 5) | Acetone | 77 days | Discolored | 28 days | Discolored |
| 50 | | Methylethylketone | 49 days | Precipitated | 21 days | Precipitated |
| 51 | | Isophorone | 49 days | Precipitated | 21 days | Precipitated |
| 52 | | Acetophenone | 35 days | Precipitated | 14 days | Precipitated |
| 53 | | 4-hydroxy-4-methyl-2-pentanone | 56 days | Discolored | 21 days | Discolored |
| 54 | | Acetylacetone | 49 days | Precipitated | 21 days | Precipitated |
| 55 | 6) | Ethyl acetate | 35 days | Precipitated | 14 days | Precipitated |

(Note)
4) Hydrocarbon
5) Ketone
6) Ester

As is clear from Table 8, in the case the solvents were added in an amount of 2%, aggregation does not occur for at least a month and the fine metal powder is stored in a stable dispersed state. On the other hand, an increase of the amount of added solvents to 4% causes aggregation after the lapse of two to four weeks. Comparison between the same solvents reveals that, for most of the solvents, the number of days permitting storage with an addition of 2% increased to more than twice as long as the number of days permitting storage with an addition of 4%. In the case with addition of 4%, aggregation caused complete separation for some solvents, whereas such a serious aggregation did not occur for addition of 2%.

The same storage stability tests were carried out with the use of the conductive film forming composition of Tests Nos. 9, 10, 14 and 17 of Example 8, giving the same results as those shown in Table 8.

Obviously, numerous modifications and variations of the present invention are possible in light of the above teachings. It is therefore to be understood that within the scope of the appended claims, the invention may be practiced otherwise than as specifically described herein.

What is claimed is:

1. A transparent conductive film having low reflectance, comprising a lower layer containing a metal powder in a silica-based matrix, provided on the surface of a transparent substrate and an upper layer of low refractive index, wherein said lower layer further comprises a black powder, in addition to said metal powder, in the silica-based matrix and, wherein said black powder it titanium black.

2. The transparent conductive film of claim 1, wherein said metal powder comprises at least one metal selected from the group consisting of Fe, Co, Ni, Cr, W, Al, In, Zn, Pb, Sb, Bi, Sn, Ce, Cd, Pd, Cu, Rh, Ru, Pt, Ag and Au; or an alloy comprising of at least two of said metals, or a mixture comprising at least two of said metals or a mixture comprising at least two of said alloys or a combination thereof.

3. The transparent conductive film of claim 2, wherein said metal is selected from the group consisting of Ni, W, In, Zn, Sn, Pd, Cu, Rh, Ru, Pt, Ag, Bi and Au.

4. The transparent conductive film of claim 2, wherein said transparent substrate is selected from the group consisting of a CRT, plasma display, EL display, and liquid crystal display.

5. The transparent conductive film of claim 3, wherein the upper layer comprises a silica based matrix.

6. A transparent conductive film having low reflectance, comprising a lower layer containing a metal powder in a silica-based matrix, provided on the surface of a transparent substrate and an upper layer of low refractive index, wherein said lower layer further comprises a black powder, in addition to said metal powder, in the silica-based matrix, wherein said metal powder is present in a range of from 5 to 97 wt. % relative to the total amount of the metal powder and the black powder.

7. The transparent conductive film of claim 6, wherein the upper layer comprises a silica based matrix.

8. A transparent conductive film having low reflectance, comprising a lower layer containing a metal powder in a silica-based matrix, provided on the surface of a transparent substrate and an upper layer of low refractive index, wherein, in said lower layer, primary particles of the metal powder are aggregated to form secondary particles of said metal powder which are distributed so as to form a secondary net structure having pores containing therein almost no metal powder.

9. The transparent conductive film of claim 8, wherein the average area of said pores of net structure is within the range of from 2,500 to 30,000 $nm^2$ and said pores account for from 30 to 70% of the total area of the film.

10. The transparent conductive film of claim 9, wherein the average primary particle size is 2–30 nm.

11. The transparent conductive film of claim 9, which is substantially free of a binder.

12. The transparent conductive film of claim 8, wherein the upper layer comprises a silica based matrix.

13. A transparent conductive film of low reflectance, comprising a lower layer containing a metal powder in a silica-based matrix, provided on the surface of a transparent substrate and an upper layer of low refractive index, wherein said lower layer has surface irregularities; the convex portions of the lower layer have an average film thickness within a range of from 50 to 150 nm; the concave portions have an average film thickness of from 50 to 85% of that of the convex portions; and said convex portions have an average pitch in a range of from 20 to 300 nm.

14. The transparent conductive film of claim 13 wherein the metal powder has an average primary particle size of 5–50 nm.

15. The transparent film of claim 14 wherein said transparent substrate is selected from the group consisting a CRT, plasma display, EL display and liquid crystal display.

16. The transparent conductive film of claim 13, wherein said metal powder comprises at least one metal selected from the group consisting of Fe, Co, Ni, Cr, W, Al, In, Zn, Pb, Sb, Bi, Sn, Ce, Cd, Pd, Cu, Rh, Ru, Pt, Ag and Au; or an alloy comprising of at least two of said raw metals, or a mixture comprising at least two of said metals or a mixture comprising at least two of said alloys or a combination thereof.

17. The transparent conductive film of claim 14, wherein the upper layer comprises a silica based matrix.

* * * * *